United States Patent [19]

Uemura et al.

[11] 4,322,180

[45] Mar. 30, 1982

[54] METHOD AND APPARATUS FOR ADVANCING CYLINDRICAL BODIES UNDERGROUND

[75] Inventors: Koichi Uemura, No. 3-11, 1-chome, Sakura-machi, Koganei-shi, Tokyo; Makoto Uemura, Koganei, both of Japan

[73] Assignee: Koichi Uemura, Tokyo, Japan

[21] Appl. No.: 99,991

[22] Filed: Dec. 4, 1979

[30] Foreign Application Priority Data

| | | | |
|---|---|---|---|
| Mar. 13, 1979 | [JP] | Japan | 54-28247 |
| Mar. 17, 1979 | [JP] | Japan | 54-30556 |
| Mar. 19, 1979 | [JP] | Japan | 54-31182 |
| Apr. 2, 1979 | [JP] | Japan | 54-38432 |

[51] Int. Cl.[3] ..... E21D 9/06

[52] U.S. Cl. ..... 405/141; 405/138; 405/184

[58] Field of Search ..... 405/136–148, 405/184; 175/62

[56] References Cited

U.S. PATENT DOCUMENTS

| | | | |
|---|---|---|---|
| 3,234,743 | 2/1966 | Levy | 175/62 X |
| 3,613,384 | 10/1971 | Jacobs | 405/143 X |
| 3,708,984 | 1/1973 | Coleman | 405/184 X |
| 3,733,835 | 5/1973 | Jacobs | 405/142 |
| 4,095,435 | 6/1978 | Uemura | 405/138 X |
| 4,122,683 | 10/1978 | Follert et al. | 405/143 X |

*Primary Examiner*—Dennis L. Taylor

*Attorney, Agent, or Firm*—Toren, McGeady & Stanger

[57] ABSTRACT

A method and an apparatus for advancing cylindrical bodies. More than two underground cylindrical bodies are laid in longitudinal alignment with thrusting jacks disposed between them. A connecting member is arranged to pierce through them. A fastener is attached to one end of the connecting member while an advancing jack arrangement which has a removable-and-attachable fastener is attached to the other end of the connecting member. A suitable anchor body is disposed in front of the alignment of cylindrical bodies. Between the anchor body and each of the cylindrical bodies, there is provided a fixing member which pierces through them. Removable-and-attachable fasteners are disposed between the fixing member and the cylindrical bodies to interlink them for moving them forward underground one after another.

23 Claims, 56 Drawing Figures

METHOD AND APPARATUS FOR ADVANCING CYLINDRICAL BODIES UNDERGROUND

BACKGROUND OF THE INVENTION

1. Field of the Invention

This invention relates to a method and an apparatus for advancing underground more than two cylindrical bodies one after another.

2. Description of the Prior Art

In the conventional methods and apparatuses for advancing underground more than two cylindrical bodies, underground cylindrical bodies have been arranged to be advanced either in a self-propelling manner or with a required reaction force for an advancing operation obtained from something other than the cylindrical bodies to be advanced. In accordance with the conventional self-propelling method, however, a self-propelling operation is impossible until two cylindrical bodies has been advanced underground. On the other hand, the conventional method of obtaining a required reaction force from something other than the cylindrical bodies has necessitated the use of a large reaction arrangement and a large advancing facility. The present invention is directed to the elimination of such shortcomings of the conventional methods and apparatuses.

SUMMARY OF THE INVENTION

It is a general object of this invention to provide a method for advancing cylindrical bodies underground wherein a traction member is inserted in a horizontal hole connecting a start pit and an arrival pit while a reaction arrangement such as an anchor body is provided in the arrival pit; and a part of a reaction force required in advancing cylindrical bodies aligned in the start pit is obtained from this reaction arrangement through the traction member. The rest of the required reaction force is obtained from the cylindrical bodies other than a cylindrical body being advanced; and thus more than two cylindrical bodies are advanced one by one underground from the start pit toward the arrival pit. Unlike the conventional methods, the invented method does not require to obtain the whole of a reaction force required for advancing a cylindrical body from a large reaction arrangement and permits to carry out construction work without interruption due to an insufficient reaction force, so that it makes possible reduction in the term of work and, accordingly, in the cost of work.

It is another object of the invention to provide an apparatus for carrying out the above stated method of the invention. In accordance with the invention: More than two underground cylindrical bodies are laid in longitudinal alignment with thrusting jacks disposed between them. A connecting member is arranged to pierce through them. A fastener is attached to one end of the connecting member while an advancing jack arrangement which has a removable-and-attachable fastener is attached to the other end of the connecting member. A suitable anchor body is disposed in front of the alignment of the cylindrical bodies. Between the anchor body and each of the cylindrical bodies, there is provided a fixing member which is arranged to pierce through them. Removable-and-attachable fasteners are disposed between the fixing member and the cylindrical bodies to interlink them for moving them forward one after another. The advantages of the invention lies in the following points:

(1) A reaction force required for advancing each of the cylindrical bodies is obtained from a total of the reaction forces of more than two other cylindrical bodies in addition to that of a reaction arrangement such as an anchor body. Therefore, compared with the conventional cylindrical body advancing process which sometimes becomes impossible when resistance to the forward movement of a cylindrical body becomes great due to uncertain conditions hidden underground requiring a greater reaction force, the arrangement of the present invention ensures a sufficiently great reaction force.

(2) Since, in accordance with the present invention, the anchor body can be simply arranged with fasteners attached to the both ends of the fixing member thereof without having various jacks attached thereto, the arrangement of the present invention permits reduction in cost of machinery and machinery handling and transportation cost.

Further in accordance with this invention, a thrusting jack arrangement is provided between the first and second cylindrical bodies; a connecting member is arranged to pierce through these cylindrical bodies with fasteners arranged to connect the connecting member with the second cylindrical body and other cylindrical bodies subsequent to the second one; at the fore end of the connecting member, a traction jack arrangement which has a removable-and-attachable fastener is attached to the first cylindrical body; a suitable anchor body is provided in front of the alignment of the cylindrical bodies while a fixing member is arranged to pierce through them with removable-and-attachable fasteners of the fixing member arranged between the anchor body and each of the cylindrical bodies, so that the cylindrical bodies are combined with each other to permit moving them forward one by one starting with the foremost one. This arrangement of the invention has the following advantages:

(1) As mentioned in the foregoing, in accordance with the conventional process, a cylindrical body sometimes cannot be moved forward because of an insufficient reaction force available when resistance to the forward movement of the cylindrical body unexpectedly becomes great due to uncertain factors hidden underground. However, in accordance with the invention, a sufficiently great reaction force for advancing each cylindrical body is obtainable from the reaction forces of a cylindrical body or cylindrical bodies other than the one being moved forward in addition to the reaction force of the anchor body.

(2) In advancing each of the second and subsequent cylindrical bodies, they can be moved forward one by one by operating only a set of traction jack arrangement provided in front of the first cylindrical body. This arrangement thus completely obviates the necessity of providing thrusting jacks between the second and subsequent cylindrical bodies.

(3) The fixing member of the anchor body can be prepared by simply attaching small, inexpensive fasteners to both ends thereof without requiring various jack arrangements there. This permits reduction in cost of machinery as well as in cost of handling and transportation of machinery.

Further, in accordance with the invention, in the initial stage of work, the first and second cylindrical bodies are moved forward by operating an advancing or thrusting jack arrangement with an anchor body, which is laid underground in front of the first cylindrical body, used as reaction body. Then, in further moving forward more than three cylindrical bodies underground, the first cylindrical body is moved forward by operating the thrusting jack arrangement while the second and subsequent cylindrical bodies are moved forward by operating the traction jack arrangement disposed in front of the first cylindrical body with a required reaction force obtained from a sum total of the reaction forces of more than two cylindrical bodies other than the one being moved forward without requiring the use of any other reaction body. Thus, unlike the conventionally practiced process for advancing cylindrical bodies, this invention does not necessitate separate arrangement of a large reaction body even where a great reaction force is required. The invention also does not require the use of any pushing materials in advancing cylindrical bodies. The features of the invention include:

(1) Use of only one set of thrusting jack arrangement suffices even where more than three cylindrical bodies are to be moved forward. This is a great economic advantage.

(2) Unlike the conventional propelling process, the invention does not necessitate the use of an enormous reaction wall and a stratum. This is an economic advantage.

(3) The invention does not require the use of a separate reaction arrangement in advancing each of the third and subsequent cylindrical bodies, because of a required reaction force can be obained from the cylindrical bodies other than the one being moved forward. This permits reduction in the term of work and, therefore, is economical.

(4) A space in the rear of the rearmost cylindrical body can be used as desired for improved operability and, accordingly, for shortening the term of work.

(5) Unlike the conventional process, wide underground cylindrical bodies can be laid over a long extended distance without requiring separate reaction arrangement.

The above and further objects, features and advantages of the invention will become apparent from the following detailed description of embodiments thereof taken in connection with the accompanying drawings.

BRIEF DESCRIPTION OF THE DRAWINGS

The accompanying drawings are schematic illustrations of preferred embodiments of the present invention. Of these drawings.

DETAILED DESCRIPTION OF PREFERRED EMBODIMENTS

EXAMPLE 1

Figure 1:
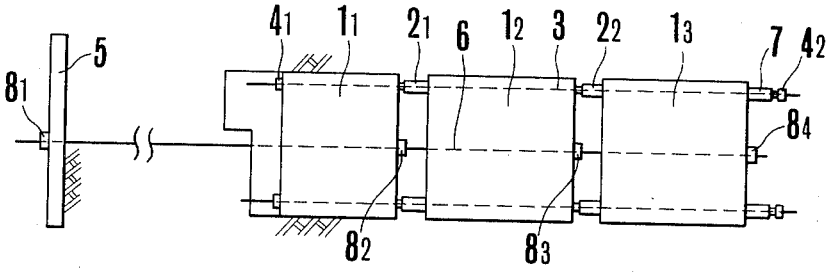
FIGS. 1–6 show the first embodiment example.

Referring to FIG. 1 which shows an embodiment of the invention as first example in which a group of three cylindrical bodies are to be moved forward, first and second thrusting jacks $\mathbf{2}_1$ and $\mathbf{2}_2$ are disposed between the three cylindrical bodies $\mathbf{1}_1$, $\mathbf{1}_2$ and $\mathbf{1}_3$. There is provided connecting members 3 which penetrate through these cylindrical bodies $\mathbf{1}_1$, $\mathbf{1}_2$ and $\mathbf{1}_3$. Each connecting member 3 is provided with a propelling or advancing jack arrangement including a traction jack 7 which has a fastener $\mathbf{4}_1$ attached to one end thereof and a fastener $\mathbf{4}_2$ attached to the other end. In front of the cylindrical body, there is provided an anchor body 5 which has a fixing member 6 piercing therethrough. The fixing member 6 is provided with fasteners $\mathbf{8}_1$, $\mathbf{8}_2$, $\mathbf{8}_3$ and $\mathbf{8}_4$ which are disposed between these cylindrical bodies $\mathbf{1}_1$, $\mathbf{1}_2$ and $\mathbf{1}_3$. These cylindrical bodies $\mathbf{1}_1$, $\mathbf{1}_2$ and $\mathbf{1}_3$, the connecting members 3, the anchor body 5, the fixing member 6, traction jacks 7 and removable-and-attachable fasteners $\mathbf{4}_1$, $\mathbf{4}_2$, $\mathbf{4}_3$, $\mathbf{8}_1$, $\mathbf{8}_2$ and $\mathbf{8}_3$ are functionally connected and combined to have the group of cylindrical bodies laid and assembled by moving them one after another.

First, the removable-and-attachable fastener $\mathbf{4}_1$ or $\mathbf{4}_2$ attached to the end of the connecting member 3 is released. The fastener $\mathbf{8}_1$ of the fixing member 6 is fixed. Then, the second cylindrical body $\mathbf{1}_2$ and its fastener $\mathbf{8}_3$ are set and fixed in place.

Figure 2:
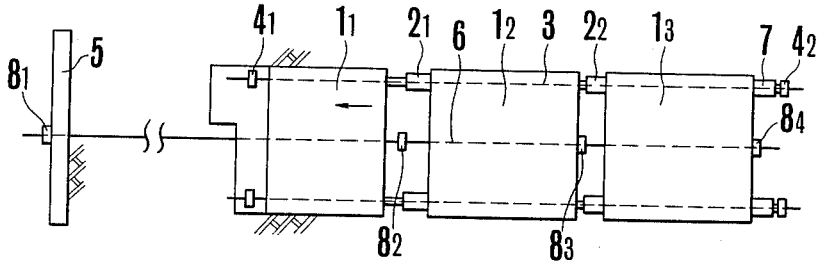

Next, referring now to FIG. 2, the thrusting jack $\mathbf{2}_1$ is operated to propel the first cylinder $\mathbf{1}_1$ with the reaction forces of the anchor body 5 and a total reaction forces of the cylinder bodies $\mathbf{1}_2$ and $\mathbf{1}_3$ used as a reaction force. The first cylinder body is thus moved forward as much as a distance l of one cycle.

Figure 3:
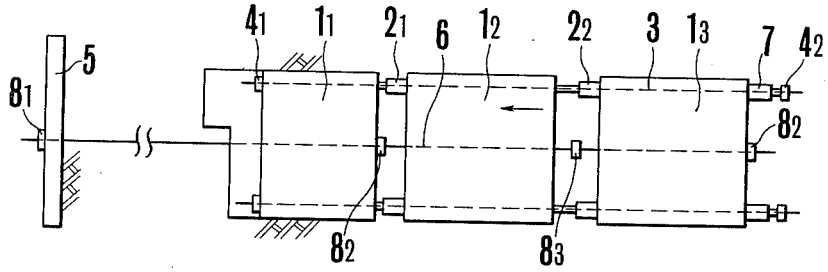
Figure 4:
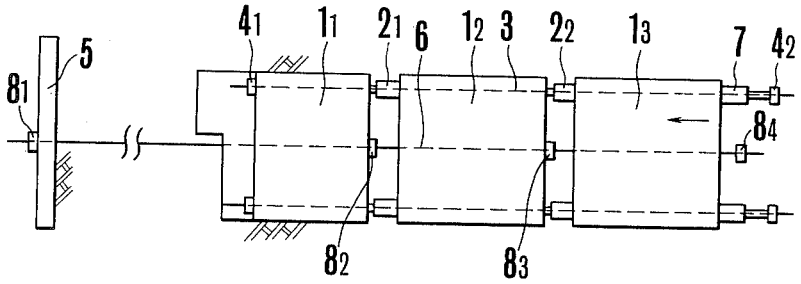

Following this, as shown in FIG. 3, the first thrusting jack $\mathbf{2}_1$ is released, the fasteners $\mathbf{4}_1$ and $\mathbf{4}_2$ of the connecting member disposed at both ends of the connecting member 3 is fixed in place to have the fixing connection of the fixing member 6 shifted from the second cylindrical body $\mathbf{1}_2$ to the first cylindrical body $\mathbf{1}_1$ with the fastener $\mathbf{8}_2$ used for this shifting. Then, the second thrusting jack is operated to have the second cylindrical body $\mathbf{1}_2$ moved forward with a necessary reaction force obtained from a total reaction force of the cylindrical bodies $\mathbf{1}_1$ and $\mathbf{1}_3$ which are linked with each other by the connecting member 3 and the fasteners $\mathbf{4}_1$ and $\mathbf{4}_2$ in addition to the reaction force of the anchor body 5 to which the first cylindrical body $\mathbf{1}_1$ is firmly connected. The second cylindrical body $\mathbf{1}_2$ is thus moved forward as much as the distance l of one cycle.

To move the third or rearmost cylindrical body $\mathbf{1}_3$ forward, the advancing jack arrangement is operated by the traction jack 7 with a necessary reaction force obtained from a total reaction force of the first and second cylindrical bodies $\mathbf{1}_1$ and $\mathbf{1}_2$ and the reaction force of the anchor body 5. The third cylindrical body $\mathbf{1}_3$ is thus also moved forward to the extent of one cycle.

In this particular embodiment example, the invention is applied to a group of three cylindrical bodies. However, the invention is not limited to such application. A larger group of cylindrical bodies also can be moved forward in exactly the same manner as the arrangement described in the foregoing.

As apparent from the foregoing description, in accordance with the method of the cylindrical body group advancing arrangement of this embodiment of the invention, the reaction force required for moving one cylindrical body forward is obtainable as a great reaction force with the reaction force of the anchor body added to a reaction force developed by the frictional resistances of the peripheries of more than two other cylindrical bodies. Therefore, the troubles that a cylindrical body becomes not advanceable due to an insufficient reaction force when there takes place an unexpected increase in resistance to the forward movement during a cylindrical body advancing process can be eliminated. The cylindrical body advancing work, therefore, can be carried out efficiently without interruption. Further, the anchor body and its fixing arrangement are used for generating an auxiliary reaction force and, therefore, can be arranged at a low cost by just providing a small fastener which is freely removable and attachable without necessitating provision of any jack arrangement at both ends of fixing arrangement. The invented arrangement thus permits reduction in installationn and handling costs.

Further, in the above embodiment example, the same effect can be attained by arranging the connecting member between the three cylindrical bodies counting from the rear of the alignment of cylindrical bodies and by arranging thrusting jacks in between the cylindrical bodies disposed in the front part of the alignment of cylindrical bodies.

In the apparatus which is arranged to carry out the above stated method, the first and second thrusting jacks $2_1$ and $2_2$ are arranged between the cylindrical bodies which are arranged in longitudinal alignment. The connecting members 3 are inserted through these cylindrical bodies $1_1$, $1_2$ and $1_3$. The fastener 4 is attached to one end of each connecting member 3 while the advancing jack arrangement consisting of the traction jack 7 and the fastener $4_2$ is attached to the other end thereof. A suitable anchor body 5 is disposed in front of the alignment of cylindrical bodies. Between the anchor body 5 and each of the cylindrical bodies $1_1$, $1_2$ and $1_3$, the fixing member 6 is arranged to pierce through them. The fasteners $8_1$, $8_2$, $8_3$ and $8_4$ which are freely removable and attachable are arranged on both ends of the fixing member 6 and between the cylindrical bodies $1_1$, $1_2$ and $1_3$ to have these cylindrical bodies $1_1$, $1_2$ and $1_3$, the connecting members 3, the anchor body 5, the fixing member 6, the traction jack 7 and the freely removable-and-attachable fasteners $4_1$, $4_2$, $8_1$, $8_2$, $8_3$ and $8_4$ functionally combined with each other. A large extendable group of cylindrical bodies thus can be moved forward one after another.

Figure 5:
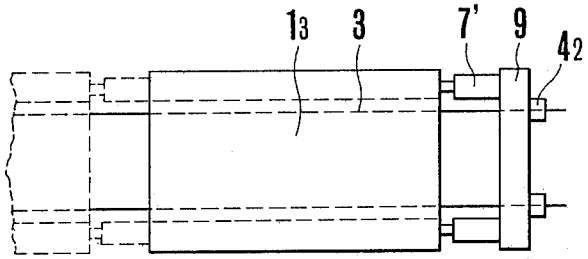

Further, as shown in FIG. 5, in the underground cylindrical body advancing apparatus, the jack-type propelling device which moves the rear cylinder body forward may be arranged without using the traction jacks 7 and, instead of using the traction jacks 7, thrusting jacks 7' may be inserted in between the rear cylinder body $1_3$ and a movement reaction member 9, which is provided in the rear parts of the connecting members and is secured to the removable-and-attachable fasteners $4_2$.

Figure 6:
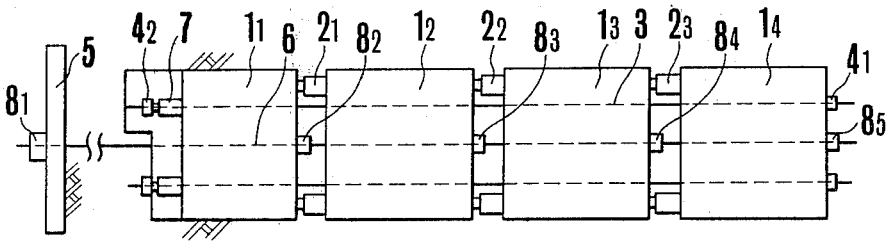

Referring now to FIG. 6, the advancing jack arrangement which is provided for moving the rear cylinder body as described in the foregoing may be provided at the front cylindrical body instead of placing it at the rear cylindrical body.

EXAMPLE 2

Figure 7:
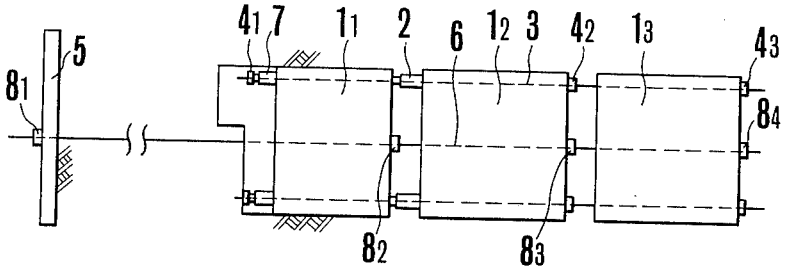
FIGS. 7–12 show the second embodiment example.

This embodiment example is also arranged to move forward a group of three cylindrical bodies. Referring to FIG. 7, thrusting jacks 2 are disposed between first and second cylindrical bodies $1_1$ and $1_2$. Connecting members 3 are arranged to pierce through cylindrical bodies $1_1$, $1_2$ and $1_3$. An advancing jack arrangement to be operated by a traction jack 7 which has a fastener $4_1$ attached in the front part thereof is disposed at the first cylindrical body $1_1$ and at the fore end of the connecting member 3. Between the connecting member 3 and the second and third cylindrical bodies $1_2$ and $1_3$, there are attached fasteners $4_2$ and $4_3$ which are removable and attachable. An anchor body 5 is provided in front of the group of cylindrical bodies. Between the anchor body 5 and each of the cylindrical bodies $1_1$, $1_2$ and $1_3$, there is provided a fixing member 6 which pierces through these cylindrical bodies and the anchor body and is provided with removable-and-attachable fasteners $8_1$, $8_2$, $8_3$ and $8_4$, these parts are arranged such that all of the cylindrical bodies $1_1$, $1_2$ and $1_3$, the connecting members 3, the anchor body 5, the fixing member 6, the traction jack 7 and the removable-and-attachable fasteners $4_1$, $4_2$, $4_3$, $8_1$, $8_2$, $8_3$ and $8_4$ are functionally linked and combined in laying and assembling the group of cylindrical bodies for moving them forward one after another.

First, the removable-and-attachable fastener $4_1$ or fasteners $4_2$ and $4_3$ are released. The fastener $8_1$ of the fixing member 6 is fixed in place and then the fasteners $8_3$ and $8_4$ are fixed in place to have the fixing member 6 firmly connected to the second and third cylindrical bodies $1_2$ and $1_3$ as shown in FIG. 7.

Figure 8:
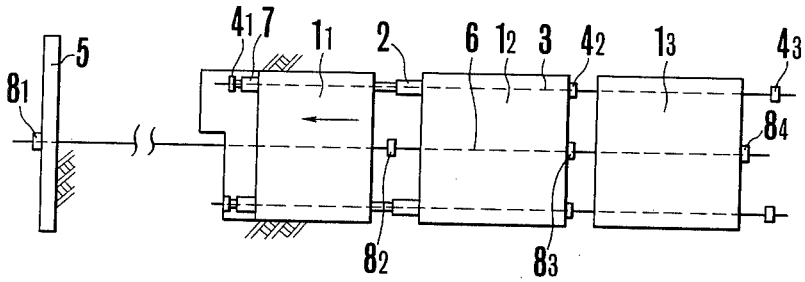

Next, the thrusting jacks 2 are operated to move the first cylindrical body $1_1$ forward as shown in FIG. 8 to an extent l of one cycle with the required reaction force obtained from the reaction force of the anchor body 5 in addition to the sum of the reaction forces of the second and third cylindrical bodies.

Figure 9:
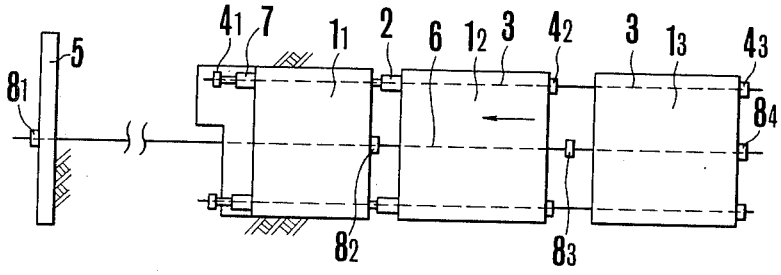

Following this, the thrusting jacks 2 are released. Then, the fasteners $4_1$ and $4_2$ which are disposed in front of the traction jacks 7 and at the second cylindrical body $1_2$ are tightened to shift the fixing connection of the fixing member 6 from the second cylindrical body $1_2$ to the first cylindrical body $1_1$ with the fastener $8_2$ used for this shifting. After that, the traction jacks 7 are operated to pull the second cylindrical body $1_2$ to move it to the extent l of one cycle as shown in FIG. 9 with the reaction force required for this pulling operation obtained from a sum total of the reaction force of the first cylindrical body $1_1$ and that of the anchor body 5 to which the first cylindrical body $1_1$ is fixedly connected by means of the fixing member 6 and the fastener $8_2$.

Figure 10:
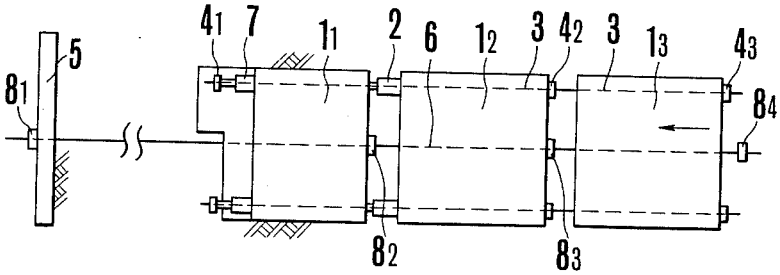
Figure 11:
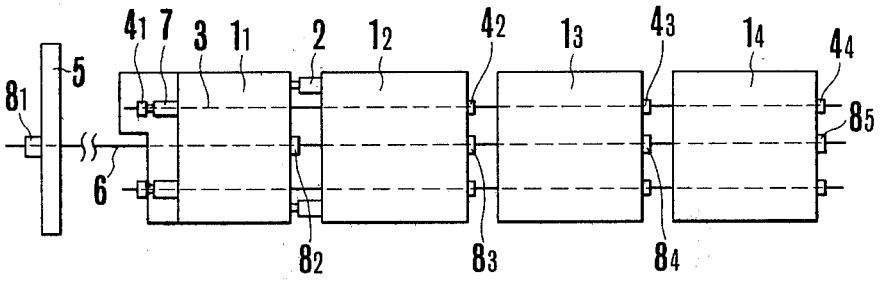
Figure 12:
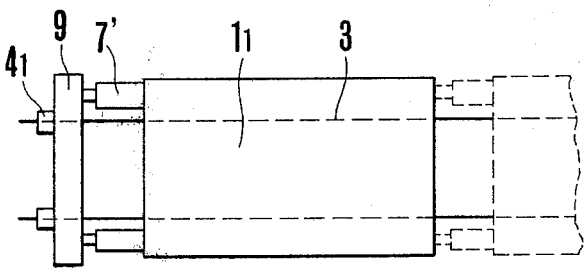

To move the third cylindrical body $1_3$ forward, the fastener $4_2$ disposed at the second cylindrical body $1_2$ is released; the fastener $4_3$ disposed at the third cylindrical body $1_3$ is tightened; and the advancing jack arrangement is operated by the traction jacks 7 to move the third cylindrical body $1_3$ forward with the reaction force required for this obtained from the sum total of the reaction forces of the first and second cylindrical bodies and the reaction force of the anchor body 5 as shown in FIG. 10.

In the foregoing, the method of this embodiment is applied to a group of three cylindrical bodies. However, a larger group of cylindrical bodies can be also moved forward in exactly the same manner.

As apparent from the foregoing description, in accordance with the cylindrical body advancing method of this embodiment, the reaction force required for moving one cylindrical body forward is obtained also from the fixed reaction force of the anchor body in addition to the reaction force developed by the frictional resistance of the peripheries of one, or two or more than two other cylindrical bodies. In this manner, a sufficiently great reaction force is available to solve the problem that a cylindrical body becomes not advanceable due to insufficient reaction force when there happens an unexpected increase in resistance to the forward movement of the cylindrical body. Further, the required number of jacks includes only a pair of traction jacks and a pair of thrusting jacks. All of the many cylindrical bodies including the second cylindrical body and other cylindrical bodies subsequent thereto are arranged to be pulled by means of the pair of traction jacks one by one and increase in the number of cylindrical bodies to be laid and moved forward does not necessitate use of a greater number of jacks. The reaction force of the anchor body is obtained through a fixing member with small, removable-and-attachable fasteners simply attached to both ends of the fixing member without any jacks attached thereto. Therefore, the arrangement of this embodiment can be installed and operated at a very low cost.

In the apparatus adapted for carrying out the method described in the foregoing, the thrusting jacks 2 are arranged between the first and second cylindrical bodies in the group of cylindrical bodies $\mathbf{1}_1$, $\mathbf{1}_2$ and $\mathbf{1}_3$ which are laid in longitudinal alignment. The connecting members 3 are arranged to pierce through the cylindrical bodies $\mathbf{1}_1$, $\mathbf{1}_2$ and $\mathbf{1}_3$. On the fore end parts of the connecting members 3, there is provided an advancing jack arrangement consisting of the traction jacks 7 each of which has the fastener $\mathbf{4}_1$ which is attached to the fore end thereof. Between each of the connecting members 3 and the second and third cylindrical bodies $\mathbf{1}_2$ and $\mathbf{1}_3$, the fasteners $\mathbf{4}_2$ and $\mathbf{4}_3$ are removably attached.

A suitable anchor body 5 is disposed in front of the group of cylindrical bodies. The fixing member 6 is arranged to pierce through the anchor body and the cylindrical bodies $\mathbf{1}_1$, $\mathbf{1}_2$ and $\mathbf{1}_3$. Between the anchor body 5 and each of the cylindrical bodies, removable-and-attachable fasteners $\mathbf{8}_1$, $\mathbf{8}_2$, $\mathbf{8}_3$ and $\mathbf{8}_4$ are attached to the fixing member 6. In this manner, the cylindrical bodies $\mathbf{1}_1$, $\mathbf{1}_2$ and $\mathbf{1}_3$, the connecting members 3, the anchor body 5, the fixing member 6, the traction jacks 7 and the removable and attachable fasteners $\mathbf{4}_1$, $\mathbf{4}_2$, $\mathbf{4}_3$, $\mathbf{8}_1$, $\mathbf{8}_2$, $\mathbf{8}_3$ and $\mathbf{8}_4$ are functionally combined to permit moving forward the cylindrical bodies one after another beginning with the foremost cylindrical body. A larger group of cylindrical bodies can be also moved forward in this manner.

EXAMPLE 3

Referring to FIGS. 13–16 which show the third embodiment example of the invention, thrusting jacks 2 are disposed between cylindrical bodies $\mathbf{1}_1$ and $\mathbf{1}_2$. There are provided connecting members 3 which have fasteners $\mathbf{4}_1$ attached to the fore end thereof and which provided with an advancing jack arrangement consisting of traction jacks 7 with fasteners $\mathbf{4}_2$ attached to the rear end thereof. In front of the alignment of cylindrical bodies, there is provided an anchor body 5, which is pierced through by a fixing member 6. The fixing member 6 is arranged to pierce through also the cylindrical bodies $\mathbf{1}_1$ and $\mathbf{1}_2$ and is provided with removable-and-attachable fasteners $\mathbf{8}_1$, $\mathbf{8}_2$ and $\mathbf{8}_3$. The two cylindrical bodies $\mathbf{1}_1$ and $\mathbf{1}_2$, the connecting members 3, the anchor body 5, the fixing member 6, the traction jacks 7 and the removable-and-attachable fasteners $\mathbf{4}_1$, $\mathbf{4}_2$, $\mathbf{8}_1$, $\mathbf{8}_2$ and $\mathbf{8}_3$ are functionally combined with each other in laying and assembling the two cylindrical bodies to permit moving them forward one after another.

Figure 13:
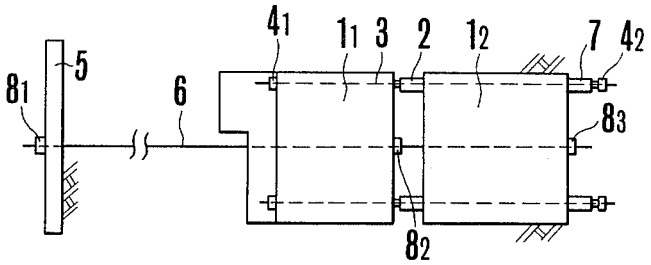
FIGS. 13–16 show the third embodiment example.

First, referring to FIG. 13, the removable-and-attachable fastener $\mathbf{4}_1$ or $\mathbf{4}_2$ provided at one end of each of the connecting members 3 is released. The fastener $\mathbf{8}_1$ of the fixing member 6 is fixed in place. The fastener $\mathbf{8}_3$ of the fixing member 6 is fixed to the second cylindrical body $\mathbf{1}_2$.

Figure 14:
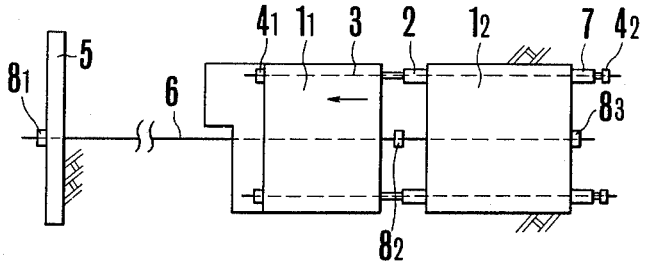

Referring now to FIG. 14, the thrusting jacks 2 are operated to move forward the first cylindrical body $\mathbf{1}_1$ to the extent l of one cycle with a reaction force required for this forward movement obtained from the reaction force of the second cylindrical body $\mathbf{1}_2$ and that of the anchor body.

Figure 15:
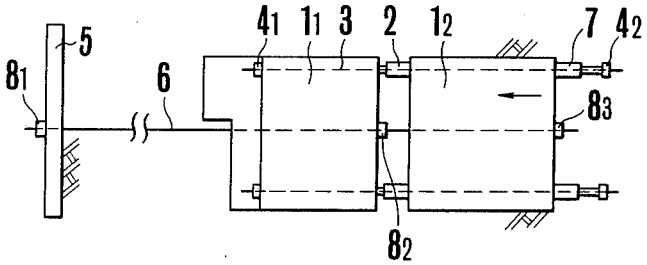

Then, the thrusting jacks 2 are released; the fasteners $\mathbf{4}_1$ and $\mathbf{4}_2$ disposed at both ends of the connecting members 3 are tightened; the fixing connection of the fixing member 6 is shifted from the second cylindrical body $\mathbf{1}_2$ to the first cylindrical body $\mathbf{1}_1$ with the fastener $\mathbf{8}_2$ used for this shifting; and then the traction jacks 7 are operated to push the second cylindrical body $\mathbf{1}_2$ and thus to move it forward as shown in FIG. 15 to the extent l of one cycle with a reaction force required for this pushing operation obtained from a sum total of the reaction force of the first cylindrical body $\mathbf{1}_1$ which is connected by the connecting member 3 and that of the anchor body 5 which is arranged to fix the first cylindrical body $\mathbf{1}_1$ in place.

With the process described in the foregoing repeated, the two cylindrical bodies can be moved forward over a desired distance.

As apparent from the foregoing description, in accordance with the method of this embodiment for advancing two cylindrical bodies, the reaction force required in moving forward one cylindrical body is obtainable as a large reaction force with the reaction force of the anchor body added to the reaction force resulting from the frictional resistance of the periphery of the other cylindrical body. By this arrangement, therefore the possibility of the trouble that a cylindrical body becomes not advanceable due to an insufficient reaction force when there happens an unexpected increase in resistance to the forward movement of the cylindrical body during a cylindrical body advancing operation can be eliminated. In accordance with the method of this embodiment of the invention, therefore, the cylindrical bodies can be efficiently moved forward without interruption.

Further, the anchor body and the fixing arrangement provided therefor are provided for the purpose of obtaining an auxiliary reaction force. Therefore, they can be installed at a low cost and can be arranged by just attaching small removable-and-attachable fasteners to both ends of the fixing member without necessitating provision of any jacks therefor.

In the apparatus which is to be used for carrying out the method described in the foregoing, the jacks 2 are disposed between the two cylindrical bodies $\mathbf{1}_1$ and $\mathbf{1}_2$ which are laid in longitudinal alignment. Each of the connecting members 3 is arranged to pierce through the two cylindrical bodies $\mathbf{1}_1$ and $\mathbf{1}_2$. The fastener 4 is attached to the fore end part of each connecting member. At the other ends of these connecting members 3, there is provided the advancing jack arrangement which is to be operated by traction jacks. A suitable anchor body 5 is disposed in front of the alignment of cylindrical bodies and is arranged in combination with a fixing member 6. The fixing member 6 is arranged to pierce through the anchor body 5 and the two cylindrical bodies $\mathbf{1}_1$ and $\mathbf{1}_2$. The fixing member 6 is provided with removable-and-attachable fasteners $\mathbf{8}_1$, $\mathbf{8}_2$ and $\mathbf{8}_3$ which are disposed at the anchor body 5 and at each of the cylindrical bodies. With this arrangement, the cylindrical bodies $1_1$ and $1_2$, the connecting members 3, the anchor body 5, the fixing member 6, the traction jacks 7 and the removable-and-attachable fasteners $4_1$, $4_2$, $8_1$, $8_2$ and $8_3$ are functionally combined to permit moving the two cylindrical bodies forward one after another.

Figure 16:
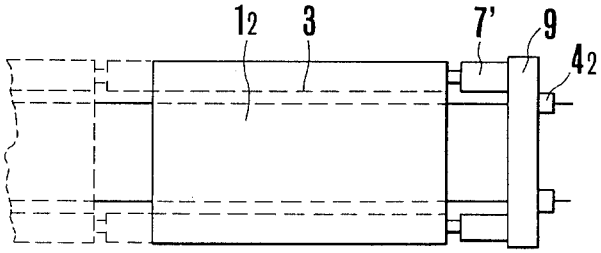

Further, referring to FIG. 16, the advancing jack arrangement which is included in the underground cylindrical body advancing apparatus described in the foregoing may be arranged, instead of using the traction jacks by inserting thrusting jacks 7' in between the rear cylindrical body and a movement reaction member 9 which is provided in the rear parts of the connecting members 3 and is secured to the removable-and-attachable fasteners $4_2$.

EXAMPLE 4

Figure 17:
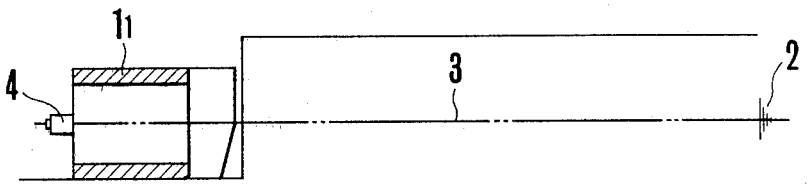
FIGS. 17–23 show the fourth embodiment example.
Figure 18:
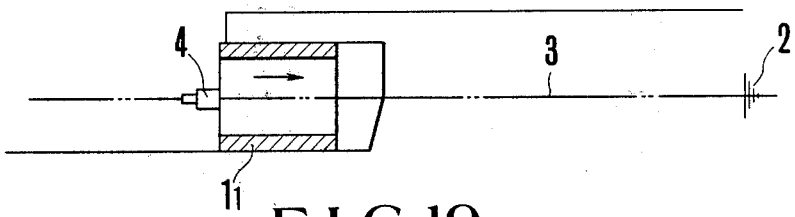

Referring to FIGS. 17–23 which show a method for moving underground cylindrical bodies forward as the fourth embodiment example of the invention, FIG. 17 shows a first process of the cylindrical body advancing method. In the first process, an anchor body 2 is laid underground in front of a first cylindrical body $1_1$. There is provided an anchor member 3 which has one end thereof anchored in the anchor body 2 and the other end thereof protrude in the rear of the first cylindrical body $1_1$. An advancing jack 4 is provided in the rear part of the first cylindrical body $1_1$ and is arranged to have the first cylindrical body advanced underground by pulling the anchor member 3 as shown in FIG. 18.

Figure 19:
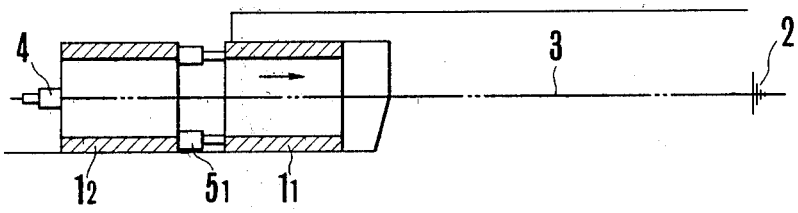
Figure 20:
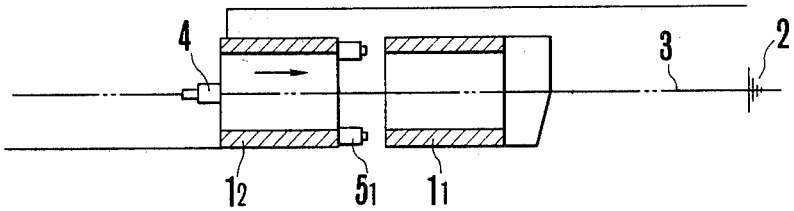

In the second process, the advancing jack 4 is transferred from the rear part of the first cylindrical body $1_1$ to the rear part of a second cylindrical body $1_2$ which is laid after the first cylindrical body $1_1$. Then, first thrusting jacks $5_1$ are positioned in between the first and second cylindrical bodies $1_1$ and $1_2$ as shown in FIG. 19. Following this, the first cylindrical body is moved forward by means of the first thrusting jacks $5_1$ with a required reaction force obtained from the second cylindrical body $1_2$ which is prohibited from retreating by fixing the other end of the anchor member 3 to the advancing jack 4 as shown in FIG. 19. To move the second cylindrical body forward, the stroke of the first thrusting jacks $5_1$ is retracted and the anchor member 3 is pulled by the advancing jack 4 for the forward movement of the second cylindrical body as shown in FIG. 20.

In the third process, the anchor member 3 and the advancing jack 4 are removed. An advancing jack 6 is positioned in front of the first cylindrical body $1_1$. A fastener 8 is provided in the rear part of a third cylindrical body $1_3$. Between the second and third cylindrical bodies $1_2$ and $1_3$, there are provided second thrusting jacks $5_2$. A traction jack 6 is linked with the fastener 8 by means of a traction member 7. Following this, the first cylindrical body $1_1$ is pushed by the first thrusting jacks $5_1$ to move it forward with the second cylindrical body $1_2$ or the second cylindrical body and the third cylindrical body $1_3$ used as reaction bodies, the third cylindrical body $1_3$ being used through the second thrusting jacks $5_2$. Then, the second cylindrical body is moved forward by the second thrusting jacks $5_2$ with a required reaction force obtained from a sum total of the reaction forces of the first and third cylindrical bodies $1_1$ and $1_3$ which are linked with each other by the connecting members. Then, the third cylindrical body $1_3$ is moved forward by operating the traction jack 6 disposed in front of the first cylindrical body $1_1$ through the traction member which is fixed in place by the fastener 8 disposed in the rear part of the third cylindrical body $1_3$ while a reaction force required for advancing the third cylinder body is obtained from the reaction force of the first cylindrical body $1_1$ or from a sum total of the reaction forces of the first and second cylindrical bodies $1_1$ and $1_2$ available through the first thrusting jacks $5_1$. As for cylindrical bodies to be moved forward subsequently to the third cylindrical body $1_3$, each of them is moved forward in the same manner as the third cylindrical body by fixing the traction member 7 to the rear part of it with the fastener 8 and then by pulling it by means of the traction jack 6 disposed in front of the first cylindrical body $1_1$.

As apparent from the foregoing description, in this embodiment of the invention, the small reaction force required for moving forward the first and second cylindrical bodies is obtained from the anchor body disposed underground in front of the first cylindrical body. For the third cylindrical body and subsequent cylindrical bodies, the anchor body is no longer used nor any other reaction arrangement is required and then each of the first, second, third and subsequent cylindrical bodies can be moved forward with other cylindrical bodies used for obtaining a reaction forces required. Unlike the conventional propelling process, this embodiment of the invention does not require any separate arrangement of an enormous reaction wall and a stratum. A space behind the cylindrical bodies can be used as desired without repeating installation and removal of a stratum there. In accordance with the invention, therefore, construction work can be efficiently carried out. The invention thus permits reduction in the length of the term of work and the cost of work. Construction of an underground cylindrical wall of large diameter thus can be carried out easily over a long distance of extension thereof without requiring the use of a large reaction wall which has been necessary in accordance with the conventional construction process.

In the underground cylindrical body advancing apparatus shown in FIG. 19, the anchor body 2 is disposed underground in front of the cylindrical body $1_1$ to be moved forward. The anchor member 3 has one end thereof anchored in the anchor body and is arranged to pierce through the cylindrical body $1_1$. The advancing jack 4 is arranged to take firm hold of the other end of the anchor member 3 in the rear part of the cylindrical body $1_1$.

In the apparatus as shown in FIG. 20, the anchor body 2 is disposed underground in front of two cylindrical bodies $1_1$ and $1_2$ to be moved forward. The anchor member 3 one end of which is anchored in the anchor body 2 is arranged to pierce through these cylindrical bodies and to extend to the rear part of the cylindrical body $1_2$. Between the two cylindrical bodies $1_1$ and $1_2$, thrusting jacks $5_1$ are disposed while the advancing jack 4 is arranged in the rear part of the second cylindrical body $1_2$ to take firm hold of the anchor member 3.

Figure 21:
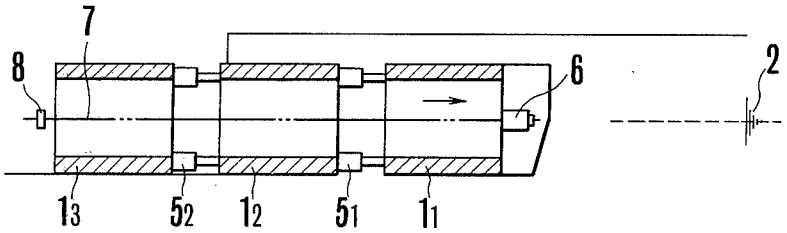
Figure 22:
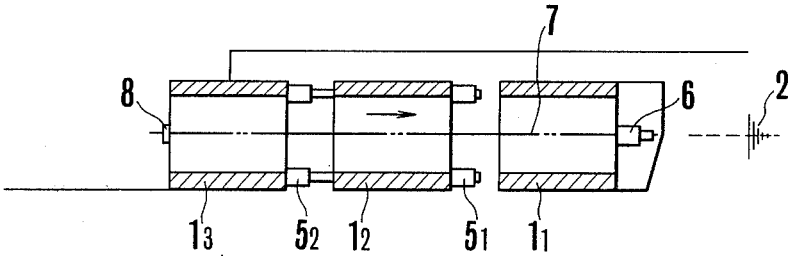
Figure 23:
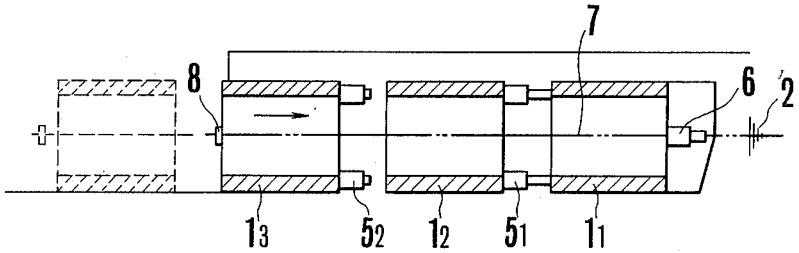
Figure 24:
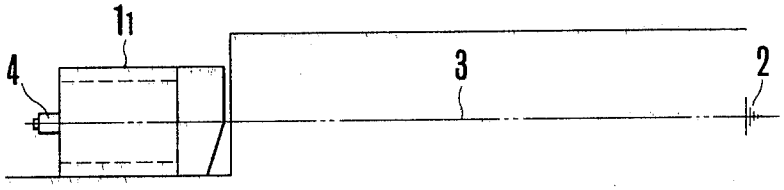
FIGS. 24–30 show the fifth embodiment example.
Figure 25:
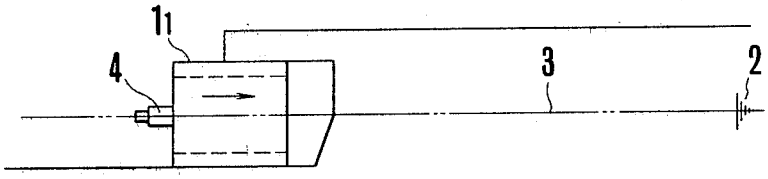
Figure 26:
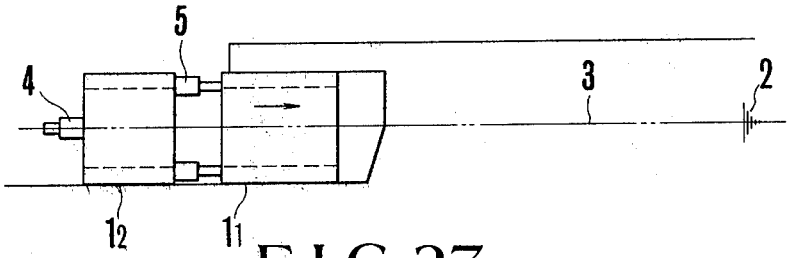
Figure 27:
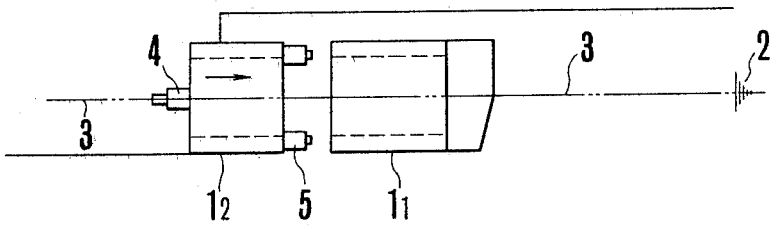
Figure 28:
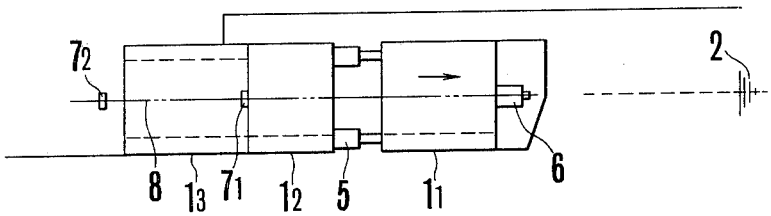
Figure 29:
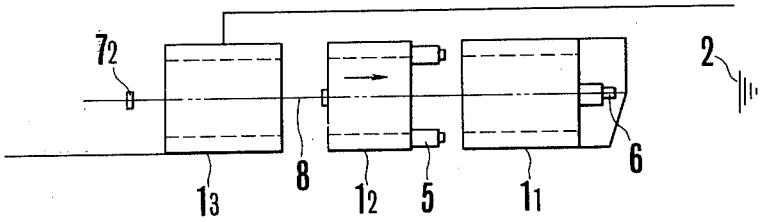
Figure 30:
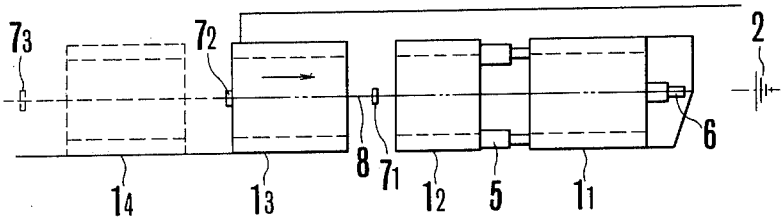

The apparatus, as shown in FIGS. 21–23, may be arranged to move forward three or more than three underground cylindrical bodies $1_1$, $1_2$, $1_3$, . . . with the traction member 7 arranged to pierce through these cylindrical bodies. In this case, a traction jack 6 is disposed in front of the first cylindrical body. Thrusting jacks $5_1$ and $5_2$ are disposed respectively in between the first and second cylindrical bodies and between the second and third cylindrical bodies. In the rear of each of the third and subsequent cylindrical bodies, there is provided the fastener 8 for the traction member 7 in combination with the traction jack 6 with the traction member 7 arranged to connect the fasteners 8 in the rear of these subsequent cylindrical bodies.

EXAMPLE 5

The fifth embodiment example of the invention is as shown in FIGS. 24–30. In this embodiment, an anchor body 2 is disposed underground in front of the first cylindrical body $1_1$. One end of an anchor member 3 is anchored in the anchor body 2 while the other end of the anchor member is arranged to protrude in the rear of the first cylindrical body. In the rear of the first cylindrical body, there is disposed an advancing jack 4 which is arranged to pull the anchor member 3, so that the first cylindrical body is moved forward in the same manner as the conventional method.

Next, a second cylindrical body $1_2$ which is shorter than the first cylindrical body $1_1$ is laid in the rear of the first cylindrical body. The advancing jack 4 is moved to the rear of the second cylindrical body. Between the first and second cylindrical bodies $1_1$ and $1_2$, there are provided thrusting jacks 5. The first cylindrical body is moved forward by the thrusting jacks 5 with the anchor body 2 and the second cylindrical body $1_2$, which is prevented from retreating by fixedly attaching the other end of the anchor member 3 to the advancing jack 4, used as reaction bodies. Then, the stroke of the thrusting jacks 5 is retracted and the advancing jack 4 is operated to pull the anchor member 3 and thus the second cylindrical body is moved forward to a desired position.

Following this, a third cylindrical body $1_3$ is laid in the rear of the second cylindrical body. The anchor member 3 and the advancing jack 4 are removed. A traction jack 6 is set in front of the first cylindrical body $1_1$ and fasteners $7_1$, $7_2$, . . . are attached to the rear of the second cylindrical body and that of each of the subsequent cylindrical bodies $1_3$, . . . . The traction jack 6 is connected to each of the fasteners $7_1$, $7_2$, . . . by means of a traction member 8. With this arrangement, the thrusting jacks 5 are operated to move the first cylindrical body forward with the second cylindrical body and the cylindrical bodies subsequent to the second cylindrical body used as reaction bodies. To move the second cylindrical body forward, the thrusting jacks 5 are released; the fastener $7_1$ is fixed in place; and the traction jack 6 is operated with the first cylindrical body $1_1$ used as reaction body. To move the third cylindrical body $1_3$, the fastener $7_1$ is released and the fastener $7_2$ is fixed in place; and the traction body 6 is operated with the first and second cylindrical bodies used as reaction bodies. After that, each of the fourth cylindrical body and cylindrical bodies subsequent to the fourth cylindrical body is moved forward in the same manner as in the case of the third cylindrical body $1_3$.

As apparent from the foregoing description, in this embodiment of the invention, the reaction force required for moving the first and second cylindrical bodies forward is obtained from the anchor body which is disposed in front of the first cylindrical body. For moving forward the third and subsequent cylindrical bodies, the use of any separate reaction body is not required and each of the first, second, third, . . . cylindrical bodies can be moved forward with the rest of the cylindrical bodies used as source of the required reaction force. The method of this embodiment, therefore, does not necessitate the use of an enormous reaction wall and a stratum. Besides, the space available in the rear of the cylindrical bodies can be freely utilized. The method of the embodiment can be carried out without repeating installation and removal of a stratum and permits reduction in the length of the term of work and the cost of work in the construction of large underground cylindrical bodies over a long extended distance.

EXAMPLE 6

Figure 31:
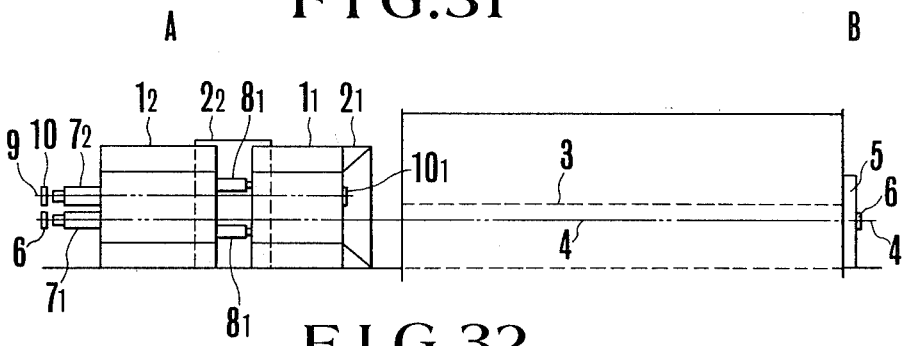
FIGS. 31–34 show the sixth embodiment example.

FIGS. 31–34 show a sixth embodiment example of the invention. In FIG. 31, there is provided a conducting hole 3 which is arranged to have a start pit A and an arrival pit B communicate with each other. A traction member 4 is arranged to pierce through the conducting hole 3 and protrude into the start and arrival pits A and B. In the arrival pit B, there is provided a reaction body 5 at the pit opening of the conducting hole. A removable-and-attachable fastener 6 is arranged to attach the traction member 4 to the reaction body 5. In the start pit A, first and second cylindrical bodies $1_1$ and $1_2$ which are to be moved forward underground are constructed. A cutting edge $2_1$ is attached to the front part of the first cylindrical body $1_1$ while a protection cylinder $2_2$ is provided between the first and second cylindrical bodies $1_1$ and $1_2$. Between the first and second cylindrical bodies, there are disposed first thrusting jacks $8_1$ which are arranged to push the first cylindrical body forward. In the rear of the second cylindrical body $1_2$, there is provided a first advancing jack arrangement $7_1$ with the traction member 4 protruding there. The first advancing jack arrangement is engaged with the traction member 4 by means of a fastener 6. A connecting member 9 is allowed to pierce through the first and second cylindrical bodies $1_1$ and $1_2$ with a removable-and-attachable fastener $10_1$ arranged in front of the first cylindrical body to be fixed to the connecting member 9. At a protruding part of the connecting member 9 in the rear of the second cylindrical body, there is disposed a second advancing jack arrangement $7_2$, which is engaged with the connecting member 9 by means of a fastener 10. The two cylindrical bodies are ready to be advanced with the arrangement completed as described in the foregoing.

Figure 32:
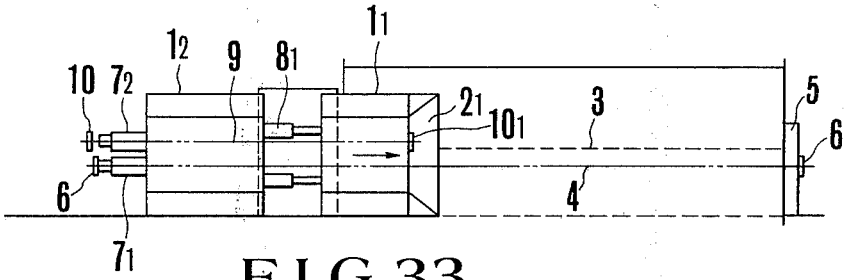
Figure 33:
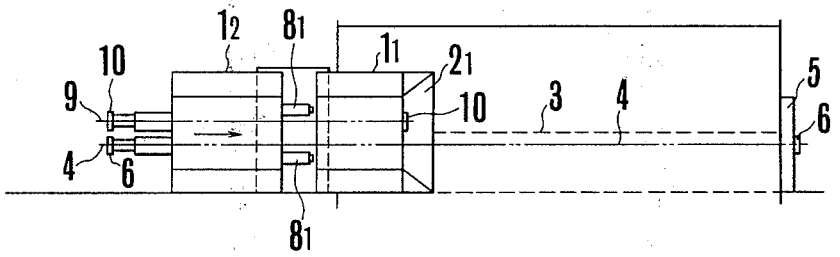

To move forward the first cylindrical body $1_1$, the fastener 10 provided in the rear of the second advancing jack arrangement $7_2$ is set free. The fastener 6 disposed in the rear of the first advancing jack arrangement $7_1$ is fixed to the traction member 4. Then, the first thrusting jack arrangement $8_1$ is operated to move forward the first cylindrical body to the extent of one stroke thereof with a required reaction force obtained from a sum total of the reaction force of the reaction body 5 and that of the second cylindrical body, as shown in FIG. 32. Referring now to FIG. 33, in moving the second cylindrical body forward, the fasteners 6 and 10 disposed in the rear of the first and second advancing jack arrangements $7_1$ and $7_2$ are respectively attached to the traction member 4 and the connecting member 9. Then, both the first and second advancing jack arrangements $7_1$ and $7_2$ are operated to move the second cylindrical body forward to the extent of one stroke with a reaction force required for this obtained from a sum total of the reaction forces developed at the reaction body and the first cylindrical body. The first and second cylindrical bodies $1_1$ and $1_2$ are thus caused to move forward underground with the above described processes repeated.

Figure 34:
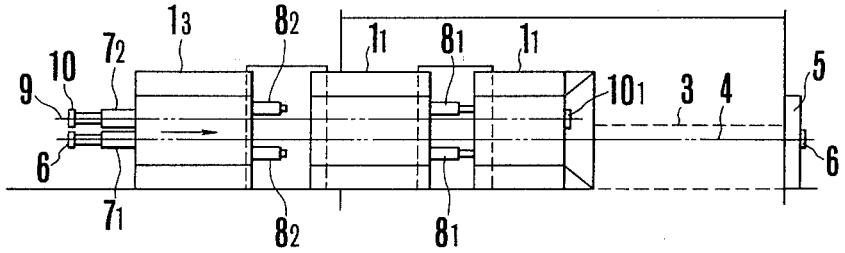

FIG. 34 shows the embodiment as applied to three cylindrical bodies. In this case, the first cylindrical body $1_1$ is moved forward by operating the first thrusting jack arrangement $8_1$ with the required reaction force obtained from a sum total of the reaction forces of the second and third cylindrical bodies $1_2$ and $1_3$ and the reaction body 5. The second cylindrical body $1_2$ is moved forward by operating the second thrusting jack arrangement $8_2$ with the required reaction force obtained from a sum total of the reaction forces of the first and third cylindrical bodies $1_1$ and $1_3$ and that of the reaction body 5. Then, to move forward the third cylindrical body $1_3$, the first and second advancing jack arrangements $7_1$ and $7_2$ are operated with a required reaction force obtained from a sum total of the reaction forces of the first and second cylindrical bodies and that of the reaction body 5. Excavation is carried out in the same manner as in the method conventionally practiced and therefore the description thereof is omitted herein.

As will be clearly understood from the foregoing description, such a start pit heretofore has been required to have a sufficiently large space for accommodating more than three cylindrical bodies therein. Whereas, in accordance with the embodiment of the invention, the start pit is not required to have such a large space and a space for two cylindrical bodies suffices. The arrival pit can be of a small size having a short space just sufficient for accommodating the reaction body therein. Further, since the cylindrical bodies other than the cylindrical body being moved forward are used for obtaining a required reaction force in addition to that of the reaction body, the reaction body does not have to be large. In cases where a conducting hole is required for correction of the advancing direction of the cylindrical bodies, the arrangement of the traction member piercing through the conducting hole dispenses with a separate horizontal hole, so that the method of this embodiment of the invention permits reduction both in the term of work and the cost of work.

In the apparatus of this embodiment of the invention, the traction member 4 is arranged to pierce through the conducting hole 3 which connects the start pit A and the arrival pit B with each other and also to pierce through the first and second cylindrical bodies. The apparatus further includes the reaction body 5 disposed within the arrival pit B at the opening of the horizontal hole; the fastener 6 which is removable and attachable and is arranged to fixedly attach the traction member 4 to the reaction body 5; the first advancing jack arrangement $7_1$ which engages the traction member 4 in the rear of the second cylindrical body $1_2$; the removable-and-attachable fastener 6 arranged in front of the first advancing jack arrangement $7_1$ to releasably fix the traction member 4 there; the first thrusting jack arrangement $8_1$ which is disposed in between the first and second cylindrical bodies $1_1$ and $1_2$; the connecting member 9 which is arranged to pierce through the first and second cylindrical bodies; the fastener 10 which is arranged to releasably fix the connecting member 9 in front of the first cylindrical body $1_1$; the second advancing jack arrangement $7_2$ which is arranged to engage the connecting member 9 in the rear of the second cylindrical body $1_2$; and the fastener 10 which is arranged to releasably fix the connecting member in place in front of the second advancing jack arrangement $7_2$ as shown in FIG. 31.

EXAMPLE 7

Figure 35:
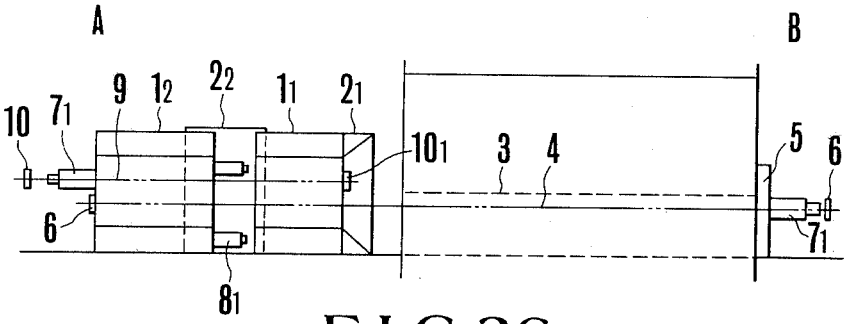
FIGS. 35–38 show seventh embodiment example.

FIGS. 35–38 show a seventh embodiment example of the invention. In a start pit A, first and second cylindrical bodies $1_1$ and $1_2$ are constructed as shown in FIG. 35. A cutting edge $2_1$ is attached to the front part of the first cylindrical body while a protection cylinder $2_2$ is disposed in between the first and second cylindrical bodies. A traction member 4 is arranged to pierce through a conducting hole 3 which connects the start pit A with an arrival pit B, the traction member 4 extending to protrude into both the start and arrival pits. On the side of the arrival pit B of the conducting hole 3, there is provided a reaction body 5. A traction-type jack arrangement $7_1$ which is provided with a removal-and-attachable fastener 6 is disposed in front of the reaction body 5. Meanwhile the traction member 4 is provided with removable-and-attachable fastener 6 which is arranged to engage the rearmost cylindrical body $1_2$. Between the first and second cylindrical bodies $1_1$ and $1_2$, there is provided a first thrusting jack arrangement $8_1$ which is arranged to push the first cylindrical body forward. Further, a removable-and-attachable fastener $10_1$ is disposed in front of the first cylindrical body and is fixed to the connecting member 9 which pierces through the first and second cylindrical bodies. In the rear of the second cylindrical body, there is provided an advancing jack arrangement $7_2$ which is arranged on the connecting member 9 protruding there and is engaged with the connecting member 9 by means of a fastener 10. The two cylindrical bodies are ready to be moved forward with the above stated arrangement completed.

Figure 36:
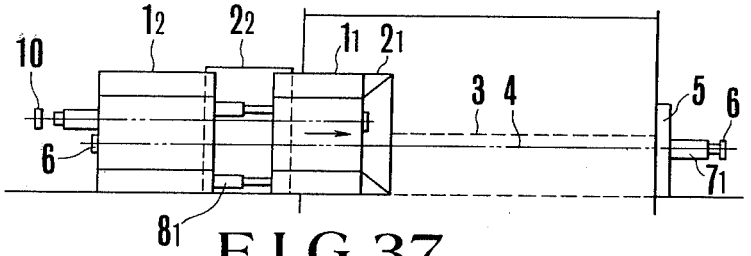
Figure 37:
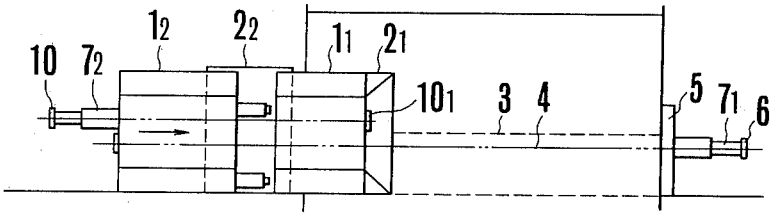

Referring to FIG. 36, in moving the first cylindrical body forward, the fasteners 6 are fixedly attached to the both ends of the traction member 4. The traction member 4 is tightened by the traction-type jack arrangement $7_1$. Then, the first thrusting jack arrangement $8_1$ is operated to move the first cylindrical body forward to the extent of one stroke with a required reaction force obtained from a sum total of the reaction force developed at the reaction body 5 and the reaction force of the second cylindrical body. To move the second cylindrical body forward, the second cylindrical body is pulled by the traction-type jack arrangement $7_1$ using the reaction force of the reaction body 5 through the traction member 4 and, concurrently with this, the advancing jack arrangement $7_2$ is operated to move the second cylindrical body forward to the extent of one stroke with the reaction force of the first cylindrical body used for this as shown in FIG. 37. The first and second cylindrical bodies are moved forward underground by repeating the processes described in the foregoing.

Figure 38:
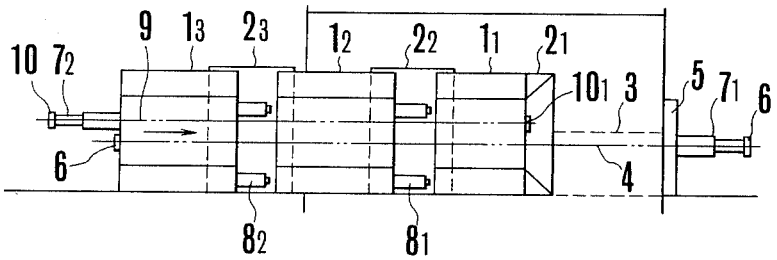

FIG. 38 illustrates this embodiment as applied to three cylindrical bodies. In this case, the first cylindrical body is moved forward by operating the first thrusting jack arrangement $8_1$ with a required reaction force obtained from a sum total of the reaction forces of the second and third cylindrical bodies $1_2$ and $1_3$ and that of the reaction body 5. The second cylindrical body is moved forward by operating the second thrusting jack arrangement $8_2$ with a required reaction force obtained from a sum total of the reaction forces of the first and third cylindrical bodies and that of the reaction body 5. Then, in moving the third cylindrical body forward, the advancing jack arrangement $7_2$ and the traction-type jack arrangement $7_1$ are simultaneously operated to move the third cylindrical body forward with a sum total of the reaction forces of the first and second cylindrical bodies and that of the reaction body 5 used for the forward moving operation. In case where four or more than four cylindrical bodies are to be moved forward, they are moved one by one in a manner similar to the processes described above. The excavating method is the same as the conventional method and, therefore, is omitted from description herein.

Heretofore, the start pit has been required to have a space for accommodating more than three cylindrical bodies in cases where more than three cylindrical bodies are to be moved forward. Whereas, in accordance with the method of this embodiment of the invention, a space for only two cylindrical bodies is required for the start pit. The arrival pit is required to have only a small space that is sufficient just to provide the reaction body therein. Further, since the cylindrical bodies other than the cylindrical body being moved forward are used for obtaining a required reaction force in addition to the reaction body, the reaction body does not have to be large. In cases where a conducting hole is required for correction of the advancing direction of the cylindrical bodies, the provision of the traction member piercing through the conducting hole dispenses with separate arrangement of transverse holes, so that the method of this embodiment of the invention permits reduction both in the term of work and the cost of work.

The apparatus of this embodiment of the invention, as shown in FIGS. 35–38, comprises: The traction member 4 which pierces through the conducting hole 3 connecting the start pit A with the arrival pit B and also pierces through the first and second or the first, second and third cylindrical bodies; the reaction body disposed at the opening of the conducting hole 3 on the side of the arrival pit B; the traction-type jack arrangement $7_1$ which is provided with the fastener 6 which is removable from and attachable to the traction member 4 in front of the reaction body 5; another fastener 6 which is arranged to be removable from and attachable to the traction member 4 in the rear of the rearmost cylindrical body $1_2$ or $1_3$; the thrusting jack arrangements $8_1$ and $8_2$ which are disposed between the cylindrical bodies $1_1$ and $1_2$ and between the cylindrical bodies $1_2$ and $1_3$; the connecting member 9 which is arranged to pierce through these cylindrical bodies; the fastener 10 which is arranged to releasably fix the connecting member 9 in front of the first cylindrical body; the advancing jack arrangement $7_2$ which is arranged to engage the connecting member 9 in the rear of the rearmost cylindrical body $1_2$ or $1_3$; and another fastener 10 which is arranged to releasably fix the connecting member 9 in front of the advancing jack arrangement $7_2$.

EXAMPLE 8

An eighth embodiment example of the invention is as shown in FIGS. 39–42. There is provided a horizontal hole 3 which is arranged to connect a start pit A with an arrival pit B. A traction member 4 is arranged to pierce through the hole 3 and extends into the start and arrival pits. Within the arrival pit B and at the opening of the horizontal hole 3, there is provided a reaction body 5. On the reaction body 5, there is provided a traction-type jack arrangement $7_1$ which is equipped with a fastener 6. The fastener 6 is arranged to be removable from and attachable to the traction member 4. On the side of the start pit A, first and second cylindrical bodies $1_1$ and $1_2$ which are to be moved forward underground are constructed within the start pit A. A cutting edge $2_1$ is attached to the front part of the first cylindrical body $1_1$. A protection cylinder $2_2$ is provided between the first and second cylindrical bodies $1_1$ and $1_2$. Between the first and second cylindrical bodies, there is provided a first thrusting jack arrangement $8_1$ which is arranged to push the first cylindrical body forward. The rear parts of the first and second cylindrical bodies are arranged to be engaged with the traction member 4 by means of fasteners $6_1$ and $6_2$. Further, a connecting member 9 is arranged to pierce through the first and second cylindrical bodies and to protrude from them. A removable-and-attachable fastener $10_1$ is fixedly attached to the connecting member 9 in front of the first cylindrical body. In the rear of the second cylindrical body, there is provided an advancing jack arrangement $7_2$ which has a fastener 10, the fastener 10 being arranged to be removable from and attachable to the connecting member 9. The two cylindrical bodies are ready to be moved forward upon completion of the above stated arrangement.

Figure 40:
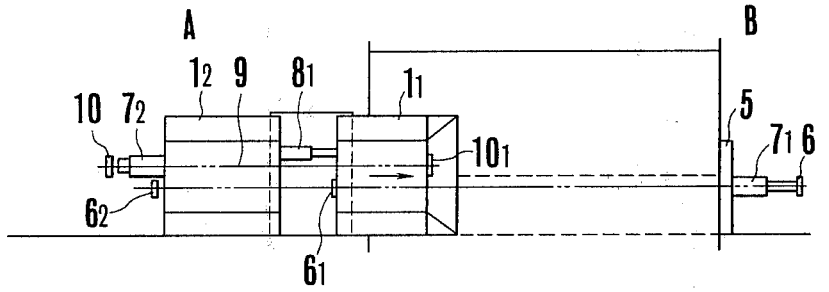
Figure 41:
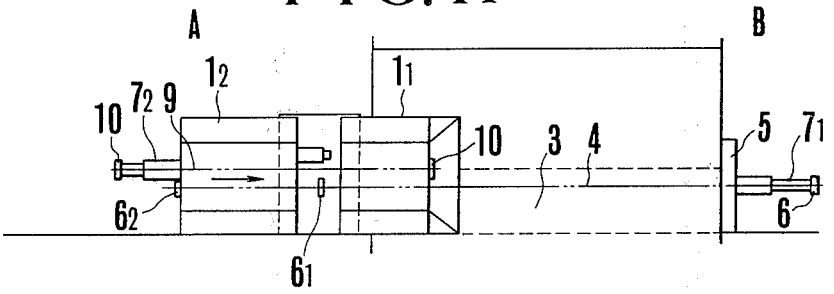

Referring to FIG. 40, in moving the first cylindrical body forward, the fastener 10 is set free in the rear of the advancing jack arrangement $7_2$. The fastener $6_1$ is fixed in place in the rear of the first cylindrical body. The fastener 6 is fixed in place in front of the traction-type jack arrangement $7_1$. The traction-type jack arrangement $7_1$ is operated to pull the first cylindrical body using the reaction force of the reaction body 5 and, at the same time, the first thrusting jack arrangement $8_1$ is operated to push the first cylindrical body using the reaction force of the second cylindrical body. The first cylindrical body is thus moved forward to the extent of one stroke. Following this, to move the second cylindrical body forward, the fastener $6_1$ disposed in the rear of the first cylindrical body is set free. The fastener $6_2$ is fixed in place in the rear of the second cylindrical body. The fastener 6 and the fastener 10 of the traction-type jack arrangement $7_1$ and the advancing jack arrangement $7_2$ are respectively firmly attached to the traction member 4 and the connecting member 9. Then, the advancing jack arrangement $7_2$ is operated to pull the connecting member 9 using the reaction force of the first cylindrical body and, at the same time, the traction-type jack arrangement $7_1$ is operated to pull the traction member 4 to have the second cylindrical body moved forward to the extent of one stroke as shown in FIG. 41. The first and second cylindrical bodies are thus moved forward underground in one direction one by one by repeating the processes described above.

Figure 42:
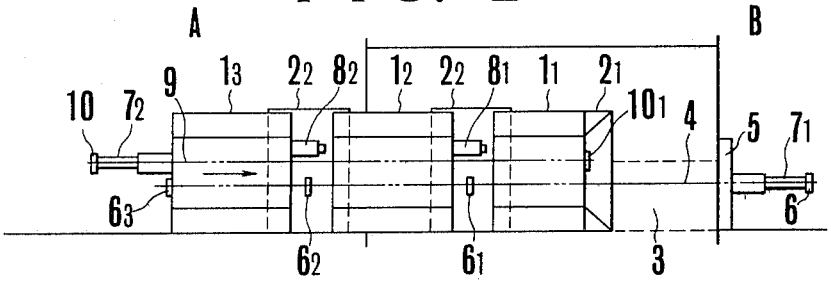
Figure 43:
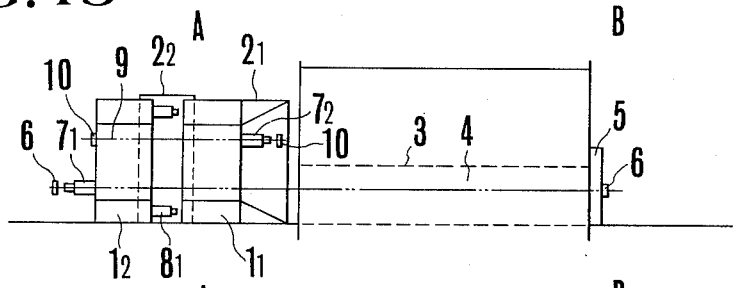
FIGS. 43–48 show the ninth embodiment example.

FIG. 42 shows this embodiment as applied to an advancing operation on three cylindrical bodies instead of two. In moving the first cylindrical body $1_1$, a first thrusting jack arrangement $8_1$ is operated with a required reaction force obtained from a sum total of the reaction forces of the second and third cylindrical bodies $1_2$ and $1_3$ available through a second thrusting jack arrangement $8_2$ and that of the reaction body 5 and, concurrently with this, the traction-type jack arrangement is operated to pull and move forward the first cylindrical body. In moving the second cylindrical body forward, the first and third cylindrical bodies are interlinked with each other by the connecting member 9 and the fastener $10_1$. Then, both the second thrusting jack arrangement $8_2$ and the traction-type jack arrangement $7_1$ are operated to move the second cylindrical body forward with a sum total of the reaction forces of the first and third cylindrical bodies and that of the reaction body 5 used for the advancing operation. In moving the third cylindrical body $1_3$ forward, the advancing jack arrangement $7_2$ and the traction-type jack arrangement $7_1$ are simultaneously operated to move the third cylindrical body forward with a required reaction force obtained from a sum total of the reaction forces of the first and second cylindrical bodies available through the first thrusting jack arrangement $8_1$ and that of the reaction body 5. In cases where four or more than four cylindrical bodies are to be moved forward, they are moved forward in a manner similar to the processes described above. The method for excavation is the same as the conventional method and, therefore, is omitted from description herein.

As apparent from the above description, the cylindrical bodies are moved forward by pulling them with the traction-type jack arrangement one by one starting with the foremost one. Therefore, the thrusting jack arrangement to be provided between these cylindrical bodies can be of a very small size. Unlike the conventional method which requires a large space for accommodating more than three cylindrical bodies within a start pit, therefore, this embodiment of the invention requires a space for accommodating only two cylindrical bodies within the start pit. As for the arrival pit, since the cylindrical bodies other than the cylindrical body being moved forward are used for obtaining a required reaction force in addition to the reaction body, the reaction body does not have to be of a large size and, accordingly, the arrival pit is required to have only a small space just sufficient to accommodate the reaction body therein. In cases where a conducting hole is required to have the cylindrical bodies moved forward in the correct direction, the arrangement of the traction member piercing through the conducting hole dispenses with separate arrangement of a horizontal hole for that purpose, so that the method of this embodiment of the invention permits reduction both in the term of work and the cost of work. Further, after three cylindrical bodies have been moved forward underground, the traction-type jack arrangement may be moved to the rear of the rearmost cylindrical body and, with a thrusting jack arrangement added between cylindrical bodies, a self-advancing facility may be obtained in accordance with the method of this embodiment.

Figure 39:
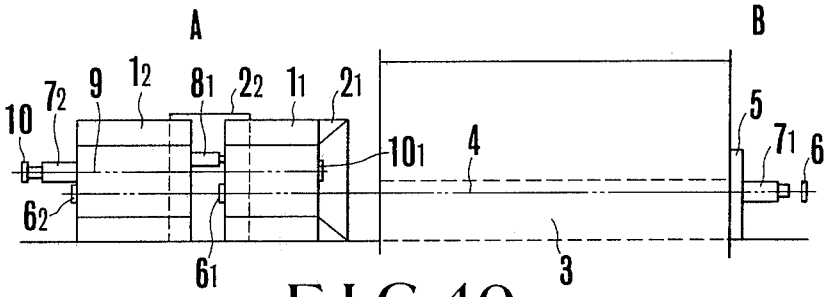
FIGS. 39–42 show the eighth embodiment example.

The apparatus of this embodiment of the invention comprises, as shown in FIG. 39, the traction member 4 which pierces through the horizontal hole 3 connecting the start pit A with the arrival pit B and also pierces through the first and second cylindrical bodies to protrude to the outsides thereof; the reaction body 5 disposed at the opening of the horizontal hole 3 on the side of the arrival pit B; the traction-type jack arrangement $7_1$ which is disposed on the reaction body 5 and is provided with the fastener 6 arranged to be removable from and attachable to the traction member 4; the fasteners $6_1$ and $6_2$ which are arranged to engage the traction member 4 with the rear parts of the first and second cylindrical bodies; the first thrusting jack arrangement $8_1$ disposed between the first and second cylindrical bodies; the connecting member 9 which pierces through the first and second cylindrical bodies; the fastener $10_1$ which releasably fixes the connecting member in front of the first cylindrical body; and the advancing jack arrangement $7_2$ which is disposed in the rear of the second cylindrical body and is arranged to releasably fix the connecting member 9 in the rear of the second cylindrical body.

EXAMPLE 9

A ninth embodiment example of the invention is as shown in FIGS. 43–47. A horizontal hole 3 is arranged to have a start pit A and an arrival pit B communicate with each other. A traction member 4 is arranged to pierce through the inside of the horizontal hole 3 and to project into the start and arrival pits. Within the arrival pit B and at the opening of the horizontal hole 3, there is provided a reaction body 5 with the traction member 4 fixed to the reaction body by means of a removable-and-attachable fastener 6. In the start pit A, first and second cylindrical bodies $1_1$ and $1_2$ which are to be moved forward underground are constructed therein. A cutting edge $2_1$ is attached to the front part of the first cylindrical body $1_1$ while a protection cylinder $2_2$ is disposed between the first and second cylindrical bodies. Between the first and second cylindrical bodies, there is provided a first thrusting jack arrangement $8_1$ which is arranged to push the first cylindrical body forward. The traction member 4 is allowed to protrude in the rear of the second cylindrical body $1_2$. Then, a first advancing jack arrangement $7_1$ which is provided with a fastener 6 is arranged to engage the traction member 4 in the rear of the second cylindrical body. Further, a connecting member 9 is arranged to pierce through the first and second cylindrical bodies. In the rear of the second cylindrical body, a removable-and-attachable fastener 10 of the connecting member 9 is fixed to the second cylindrical body. Meanwhile, a second advancing jack arrangement $7_2$ which is provided with another fastener 10 is arranged to engage the protruding part of the connecting member 9 in front of the first cylindrical body. The two cylindrical bodies are ready to be moved forward upon completion of the arrangement described above.

Figure 44:
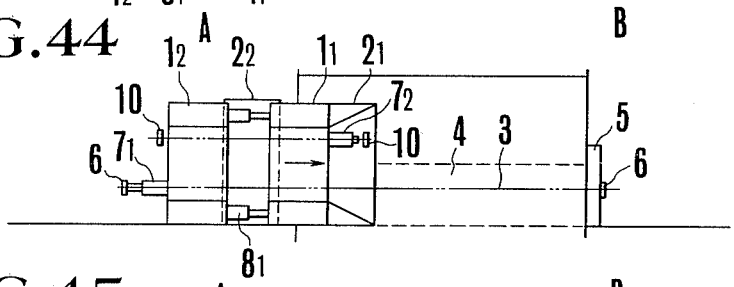
Figure 45:
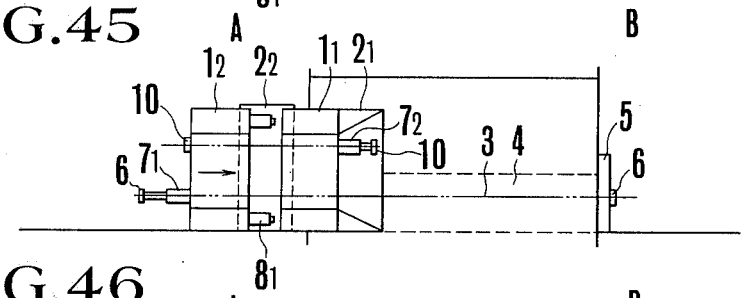

In moving the first cylindrical body $1_1$ forward, as shown in FIG. 44, the fastener 10 is set free in the rear of the second cylindrical body. The fastener 6 in the rear of the first advancing jack arrangement $7_1$ is fixed to the traction member 4. Then, the first thrusting jack arrangement $8_1$ is operated to move the first cylindrical body forward to the extent of one stroke with a required reaction force obtained from a sum total of the reaction force developed by the reaction body through the traction member 4 and that of the second cylindrical body. In moving the second cylindrical body, as shown in FIG. 45, the fastener 10 disposed in the rear of the second cylindrical body is fixed to the connecting member 9. The fasteners 6 and 10 which are disposed in the rear of the first and second advancing jack arrangements $7_1$ and $7_2$ are respectively attached to the traction member 4 and the connecting member 9. Then, both the first and second advancing jack arrangements $7_1$ and $7_2$ are operated to move the second cylindrical body forward to the extent of one stroke with a required reaction force for this obtained from a sum total of the reaction forces developed at the first cylindrical body and the reaction body 5. The first and second cylindrical bodies are thus advanced underground one by one by repeating the processes described above.

Figure 46:
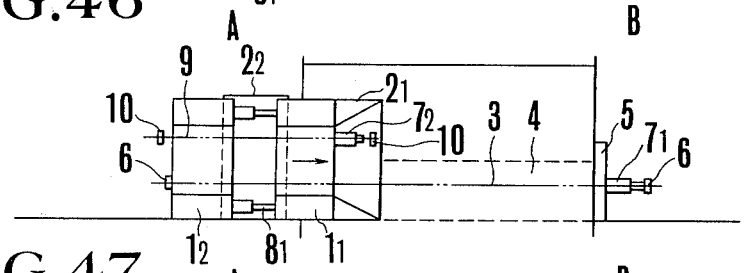

FIG. 46 shows a modification of this embodiment, in which: The fastener to be disposed at one end of the traction member 4 is positioned in the rear of the second cylindrical body $1_2$ while the first advancing jack arrangement to be disposed at the other end of the traction member 4 is positioned at the reaction body 5. The advancing process is carried out in the same order of steps as in the process described in the foregoing.

Figure 47:
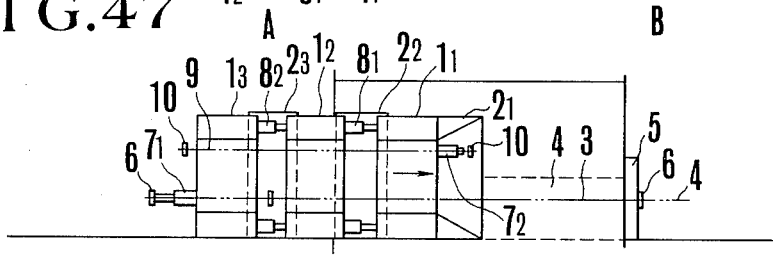

FIG. 47 shows a further modification in which this embodiment is applied to three cylindrical bodies. In advancing the first cylindrical body $1_1$, the first thrusting jack arrangement $8_1$ is operated to move it forward with a required reaction force obtained from a sum total of the reaction forces of the second and third cylindrical bodies available through the second thrusting jack arrangement $8_2$ and the reaction force of the reaction body 5 available through the traction member 4. In advancing the second cylindrical body $1_2$, the second thrusting jack arrangement $8_2$ is operated to move it forward with a required reaction force obtained from a sum total of the reaction forces of the first and third cylindrical bodies available through the connecting member 9 and that of the reaction body 5. The third cylindrical body is moved forward by operating the first and second advancing jack arrangements $7_1$ and $7_2$ with a required reaction force obtained from a sum total of the reaction forces of the first and second cylindrical bodies $1_1$ and $1_2$ and that of the reaction body 5. The same process applied also in moving four or more than four cylindrical bodies forward. The method for excavation is the same as the conventionally practiced method and, therefore, is omitted from description herein.

Heretofore, a space for accommodating at least three cylindrical bodies has been required for a start pit. However, as will be clearly understood from the above description, a space for accommodating only two cylindrical bodies suffices for the start pit of this embodiment of the invention. Meanwhile, only a short space is required for accommodating the reaction body within the arrival pit. Therefore, relatively small pits are usable in accordance with this embodiment of the invention. Since the cylindrical bodies other than the cylindrical body being moved forward are utilized for obtaining a required reaction force in addition to the reaction body, the reaction body can be of a small size. In cases where a conducting hole is required to have the cylindrical bodies moved forward in the correct direction, the arrangement of the traction member piercing through the conducting hole dispenses with separate arrangement of a horizontal hole for that purpose, so that the method of this embodiment of the invention permits reduction in the term of work and the cost of work.

Figure 48:
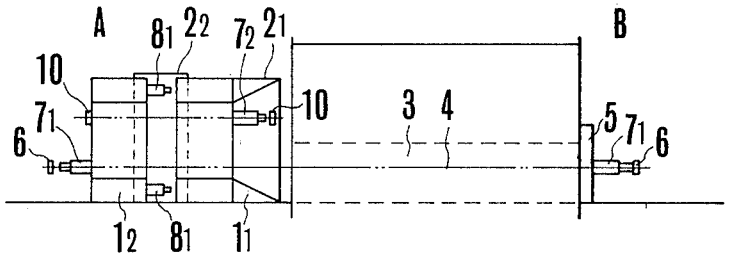

In another modification of this embodiment of the invention as shown in FIG. 48, the fastener 6 which is disposed at one end of the traction member 4 is replaced with a first additional advancing jack arrangement $7_1$. When the cylindrical bodies extend over a long distance, the traction member comes to elongate too much to have the elongation absorbed by a pair of the first advancing jacks and then the cylindrical body cannot be moved further. However, in accordance with the above stated arrangement of this embodiment, while the elongation of the traction member is absorbed by one pair of the first advancing jacks, another pair of the first advancing jacks effectively works to move the cylindrical body forward.

The apparatus of this embodiment of the invention comprises: The traction member 4 which pierces through the horizontal hole 3 connecting the start and arrival pits with each other and also pierces through the first and second cylindrical bodies $1_1$ and $1_2$; the reaction body 5 disposed at the opening of the horizontal hole 3 on the side of the arrival pit B; the removable-and-attachable fastener 6 which is arranged to fix one end of the traction member 4 to the reaction body 5; the first advancing jack arrangement $7_1$ provided with the fastener 6 which is arranged to engage the other end of the traction member 4 with the rear part of the second cylindrical body $1_2$; the first thrusting jack arrangement $8_1$ which is disposed between the first and second cylindrical bodies; the connecting member 9 which is arranged to pierce through the first and second cylindrical bodies; the fastener 10 which is arranged to releasably fix the connecting member in place in front of the second cylindrical body $1_2$; and the second advancing jack arrangement $7_2$ provided with the fastener 10 which is disposed in front of the first cylindrical body $1_1$ and is arranged to have the connecting member 9 locked there.

Further, as shown in FIG. 48, in place of the fastener 6 which is disposed at one end of the traction member 4, another pair of the first advancing jacks $7_1$ may be added and engaged with the traction member 4.

EXAMPLE 10

A tenth embodiment example of the invention is as shown in FIGS. 49–56. A horizontal hole 3 is arranged to have a start pit A and an arrival pit B communicate with each other. A traction member 4 is arranged to pierce through the inside of the horizontal hole 3 and to project into the start and arrival pits A and B. At the opening of the horizontal hole 3 in the arrival pit B, there is provided a reaction body 5. Within the arrival pit B, there is provided a traction-type first advancing jack arrangement $7_1$. The first advancing jack arrangement $7_1$ is provided with a fastener 6 which is removable from and attachable to the traction member 4 and is arranged to engage the traction member 4 with the reaction body 5. In the start pin A, first, second and third cylindrical bodies $1_1$, $1_2$ and $1_3$ to be advanced underground are constructed there. A cutting edge $2_1$ is attached to the front part of the first cylindrical body $1_1$ while a protection cylinders $2_2$ are disposed between the first and second cylindrical bodies and between the second and third cylindrical bodies respectively. Between the first and second cylindrical bodies and between the second and third cylindrical bodies, there are provided first and second thrusting jack arrangements $8_1$ and $8_2$ which are arranged to push the first and second cylindrical bodies respectively. In the rear of the first and second cylindrical bodies, there are provided fasteners 6 which are arranged to have the traction member 4 locked there respectively. In the rear of the rearmost cylindrical body or the third cylindrical body $1_3$, a removable-and-attachable fastener $6_1$ of the traction member 4 is disposed to engage the traction member 4 with the rearmost cylindrical body $1_3$. Further, a connecting member 9 is arranged to pierce through the second and third cylindrical bodies $1_2$ and $1_3$. The connecting member 9 is provided with a removable-and-attachable fastener 10 which is disposed in the rear of the third cylindrical body $1_3$ and is arranged to lock the connecting member 9 there. In front of the second cylindrical body $1_2$, there is provided a propelling or advancing jack arrangement 11 which is provided with a removable-and-attachable fastener 10 for engaging the connecting member 9 with the second cylindrical body $1_2$. The three cylindrical bodies are ready to be moved forward upon completion of the arrangement described above.

Figure 50:
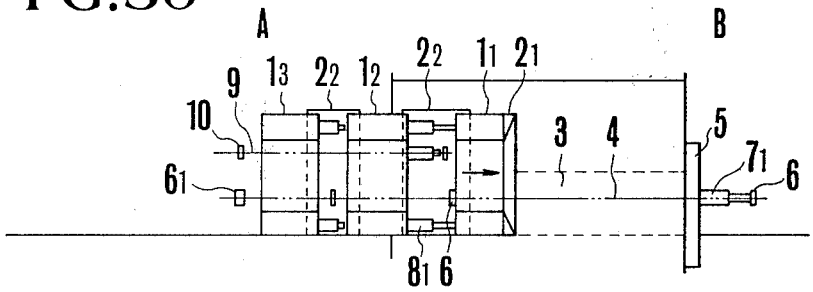
Figure 51:
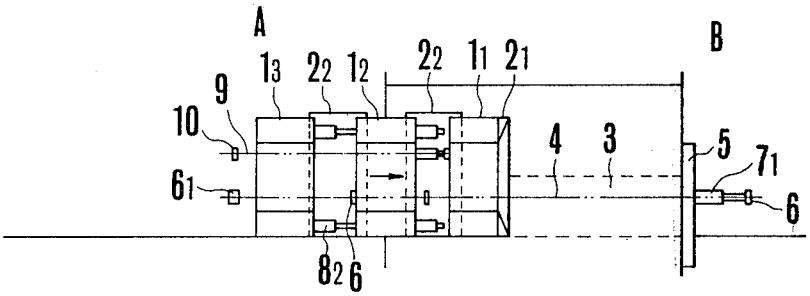
Figure 52:
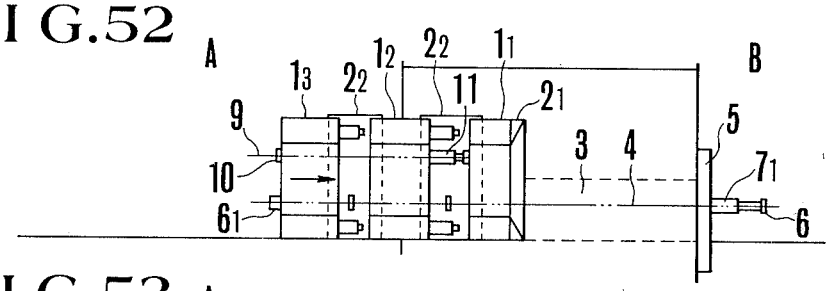

In moving the first cylindrical body forward, as shown in FIG. 50, the fastener 6 disposed in the rear of the first cylindrical body and the fastener 6 disposed in front of the traction-type first advancing jack arrangement $7_1$ are fixed in place. Then, the traction-type first advancing jack arrangement $7_1$ is operated to pull the first cylindrical body with a required reaction force obtained from the reaction body 5 and, at the same time, the first thrusting jack arrangement $8_1$ is operated to push the first cylindrical body with a required reaction force obtained either from the second cylindrical body or from a total of the reaction forces of the first and second cylindrical bodies available through the second thrusting jack arrangement $8_2$. The first cylindrical body is moved forward in this manner to the extent of one stroke. Next, in moving the second cylindrical body $1_2$ forward, as shown in FIG. 51, the fastener 6 which is disposed in the rear of the second cylindrical body is fixed in place. Then, the traction-type first advancing jack arrangement $7_1$ is operated to pull the second cylindrical body forward with a required reaction force obtained from the reaction body 5 through the traction member 4 and, at the same time, the second thrusting jack arrangement $8_2$ is operated to push the second cylindrical body with a reaction force obtained from the third cylindrical body. The second cylindrical body is thus moved forward to the extent of one stroke. In moving the third cylindrical body, as shown in FIG. 52, the fastener $6_1$ disposed in the rear of the third cylindrical body is fixed to the traction member 4. Then, the traction-type first advancing jack arrangement $7_1$ is operated to pull the third cylindrical body forward through the traction member 4 and, at the same time, the fastener 10 disposed in the rear of the third cylindrical body is fixed to the connecting member 9 and the advancing jack arrangement 11 is operated to move the third cylindrical body to the extent of one stroke through the connecting member 9 with a required reaction force obtained from the second cylindrical body. The first, second and third cylindrical bodies $1_1$, $1_2$ and $1_3$ are thus advanced underground one by one in one direction by repeating the processes described above.

Figure 53:
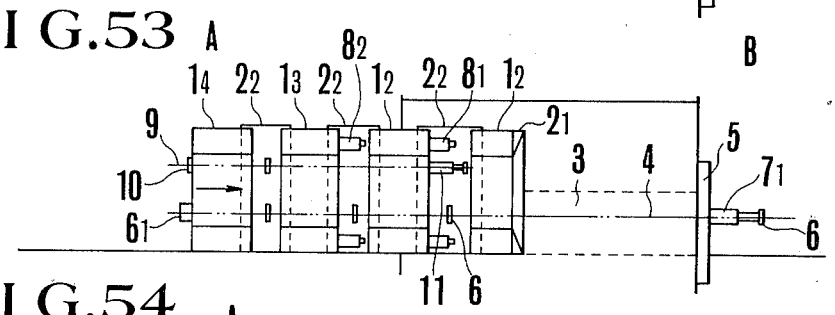

FIG. 53 shows this embodiment as applied to four cylindrical bodies instead of three. In this case, the first, second and third cylindrical bodies $1_1$, $1_2$ and $1_3$ are first moved forward in the same manner as the processes described in the foregoing. Then, the fourth cylindrical body $1_4$ is moved forward in the same manner as the process employed in moving the third cylindrical body forward as described in the foregoing. In cases where five or more than five cylindrical bodies are to be moved forward, they are also moved forward in the same manner as the processes described in the foregoing. The excavation method is the same as the conventional excavating method and, therefore, is omitted from description herein.

As apparent from the foregoing description, each of the cylindrical bodies is moved forward one by one with the traction-type first advancing jack arrangement operated in front of the cylindrical bodies. With this arrangement employed, the thrusting jack arrangement required between these cylindrical bodies can be minimized. On the other hand, the arrival pit does not have to be of a large size for accommodating the reaction body, which requires only a small space for installation, because the cylindrical bodies other than the cylindrical body being moved forward are arranged to be utilized for obtaining a required reaction force in addition to the reaction body. Further, in cases where a conducting hole is required to have the cylindrical bodies moved forward in the correct direction, the arrangement of the traction member piercing through the conducting hole obviates the necessity of arranging a separate horizontal hole for that purpose, so that the method of this embodiment permits reduction in the term of work and the cost of work. Further, after more than three cylindrical bodies have been advanced underground, the traction member may be cut off in front of the second cylindrical body and an advancing jack arrangement may be arranged there to engage the traction member with the cylindrical body. In this manner, a self-advancing facility may be obtained for advancing a group of cylindrical bodies.

Figure 49:
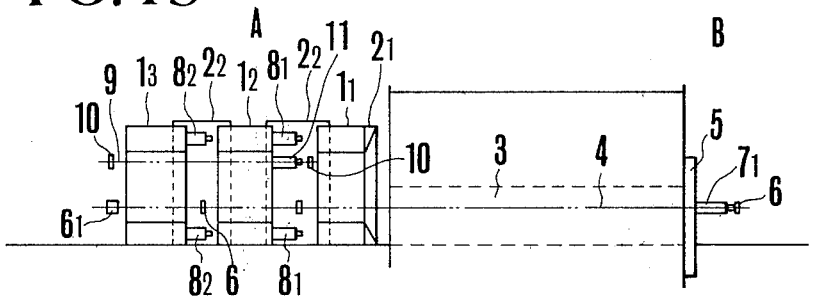
FIGS. 49–56 show the tenth embodiment example.

The apparatus of this embodiment of the invention comprises, as shown in FIG. 49, the traction member 4 which pierces through the inside of the horizontal hole 3 which connects the start and arrival pits with each other and also pierces through the first, second and third cylindrical bodies $1_1$, $1_2$ and $1_3$; the reaction body 5 disposed at the opening of the horizontal hole 3 on the side of the arrival pit B; the traction-type first advancing jack arrangement $7_1$ provided with the fastener 6 which is removable from and attachable to the traction member 4 and is arranged to have the traction member engaged with the reaction body 5; the fasteners 6 which are disposed in the rear of the first and second cylindrical bodies and are arranged to have the traction member 4 engaged with the first and second cylindrical bodies; the fastener $6_1$ which is disposed in the rear of the third cylindrical body $1_3$ and is arranged to have the traction member 4 engaged with the third cylindrical body; the first and second thrusting jack arrangements $8_1$ and $8_2$ which are disposed between the first and second cylindrical bodies and between the second and third cylindrical bodies; the connecting member 9 which is arranged to pierce through the first and second cylindrical bodies; fastener 10 of the connecting member 9 arranged to have the connecting member engaged with the third cylindrical body in the rear of the third cylindrical body; and the advancing jack arrangement 11 provided with the removable-and-attachable fastener 10 which is arranged in front of the second cylindrical body to have the connecting member 9 engaged with the second cylindrical body.

Figure 54:
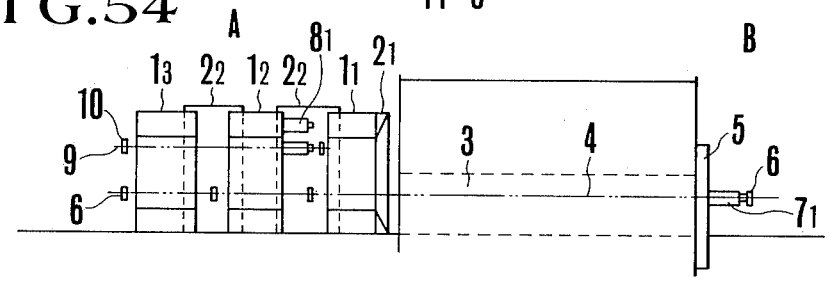

Further, in a modification of the above stated apparatus, the removable-and-attachable fastener $6_1$ may be replaced with a fastener 6 which is arranged as shown in FIG. 54 in the rear of the rearmost cylindrical body $1_3$ to engage the traction member 4 with the rearmost cylindrical body $1_3$.

Figure 55:
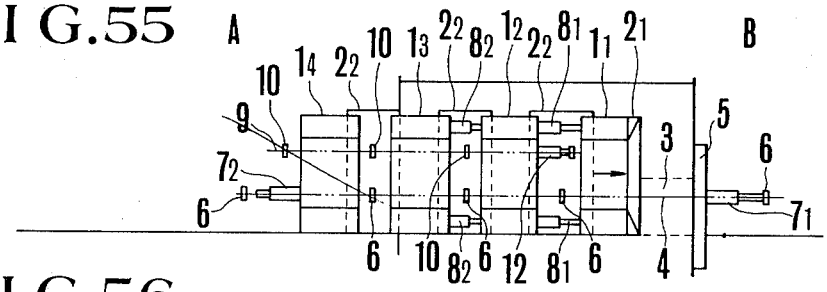

In another modification, the removable-and-attachable fastener $6_1$ may be replaced with a fastener 6 which is arranged as shown in FIG. 55 in the rear of the rearmost cylindrical body $1_4$ to engage the traction member 4 with the rearmost cylindrical body $1_4$ together with a traction-type second advancing jack arrangement $7_2$, which is arranged such that, when the traction member comes to elongate to a great degree as the extending distance of construction work increases, the elongation and slack of the traction member can be absorbed by this traction-type second jack arrangement to permit the cylindrical body to be moved forward by the traction-type first jack arrangement.

Further, the advancing jack arrangement 11 disposed in front of the second cylindrical body $1_2$ may be provided with a removable-and-attachable fastener 10 which is arranged to engage the connecting member 9 with the second cylindrical body $1_2$ in a manner as shown in FIG. 55.

Figure 56:
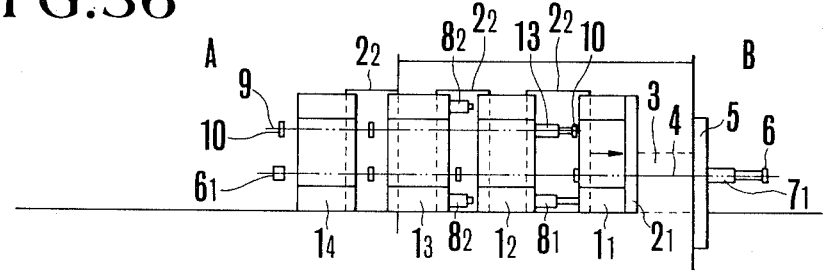

In a further modification, the advancing jack arrangement disposed in front of the second cylindrical body $1_2$ may be provided with a removable-and-attachable fastener 10 which is arranged in a manner as shown in FIG. 56. The arrangement of this modification is such that the thrusting jack arrangement which is disposed in between the first and second cylindrical bodies can be allowed to have a less thrusting force that is lessened by the thrusting force portion of a traction-and-thrusting combined jack arrangement. Therefore, this arrangement has an economic advantage.

What is claimed is:

1. A method for advancing at least two cylindrical bodies underground wherein at least two underground cylindrical bodies are laid in longitudinal alignment; thrusting jacks are disposed between said cylindrical bodies; a connecting member is arranged to longitudinally pierce through said cylindrical bodies; a fastener is provided at the fore end of said connecting member; an advancing jack arrangement which is provided with an attachable-and-removable fastener is disposed at the rear end of said connecting member; a suitable anchor body is disposed in front of the group of said cylindrical bodies and is arranged in combination with a fixing member which longitudinally pierces through said group of cylindrical bodies; said fixing member is arranged to be fixedly connected to said anchor body and to each of said cylindrical bodies by means of removable-and-attachable fasteners to interlink said cylindrical bodies for advancing them, the operation of advancing said cylindrical bodies including following steps:

said fasteners disposed at both ends of said connecting member is released; the fastener of said fixing member is fixed only to the second cylindrical body; said thrusting jacks are operated to move forward the first cylindrical body to the extent of one cycle with a reaction force required for advancing obtained from a sum total of the reaction force of said second cylindrical body and that of said anchor body which is linked therewith; then said thrusting jacks are released; said fasteners at both ends of said connecting member are tightened; fixing connection of said fixing member is shifted from said second cylindrical body to said first cylindrical body; then said advancing jack arrangement disposed in the rear of said second cylindrical body is operated to move said second cylindrical body forward to the extent of one cycle with a required reaction force obtained either from a sum total of the reaction force of said first cylindrical body and that of said anchor body which is linked therewith or from a sum total of the reaction forces of first and third cylindrical bodies and said anchor body; and said at least two cylindrical bodies can be moved forward one after another by repeating these steps.

2. A method for advancing at least two cylindrical bodies according to claim 1 wherein one of said fasteners which are removable from and attachable to said fixing member and are disposed at said anchor body and said first cylindrical body is arranged to permit adjustment to absorb elongation of said fixing member.

3. A method for advancing at least two cylindrical bodies according to claim 1 wherein said cylindrical bodies to be interlinked by means of said connecting member are three cylindrical bodies counting from the rearmost one.

4. A method for advancing at least two cylindrical bodies according to claim 1 wherein the cylindrical bodies that can be fixedly connected by said fixing member are first and second cylindrical bodies.

5. A method for advancing cylindrical bodies wherein at least three underground cylindrical bodies are laid in longitudinal alignment; thrusting jacks are disposed between first and second cylindrical bodies; a connecting member is arranged to pierce through each of said cylindrical bodies; fasteners are provided between said connecting member and each of the second cylindrical body and other cylindrical bodies subsequent thereto; a traction jack arrangement which is provided with an attachable-and-detachable fastener is disposed at the first cylindrical body and at the fore end of the connecting member; a suitable anchor body is disposed in front of the group of said cylindrical bodies, a fixing member is arranged to longitudinally pierce through said anchor body and said group of cylindrical bodies, said fixing member being arranged to interlink fixedly the anchor body and each of said cylindrical bodies by means of removable-and-attachable fasteners for advancing them one by one, the operation of advancing said group of cylindrical bodies including the following steps:

said fasteners of said connecting member are set free; said fasteners provided between said fixing member and the second and subsequent cylindrical bodies are tightened; the thrusting jacks disposed between the first and second cylindrical bodies are operated to move forward the first cylindrical body to the extent of one cycle with a required reaction force obtained from a sum total of the reaction forces of the anchor body and the second and subsequent cylindrical bodies; said thrusting jacks are released from operation; the fastener disposed between the fore end of the connecting member and the second cylindrical body is tightened; the fixed interlinking connection of said fixing member is shifted from the second cylindrical body to the first cylindrical body; said traction jack arrangement is operated to move forward to second cylindrical body to the extent of one cycle through said connecting member with a required reaction force obtained from a sum total of the reaction forces of the first cylindrical body and the anchor body; then, the fastener disposed between the connecting member and the second cylindrical body is set free and another fastener between the connecting member and the third cylindrical body is tightened; said traction jack arrangement is operated to move forward the third cylindrical body to the extent of one cycle with a required reaction force obtained from a sum total of the reaction forces of the first and second cylindrical bodies and that of the anchor body; after the three cylindrical bodies are moved forward to a desired position, a fourth cylindrical body is laid; the connecting member is extended and is removably and reattachably fixed to the fourth cylindrical body with a fastener to have it moved forward through the same process; and with the steps repeated, a group of cylindrical bodies can be moved forward one after another in a continuous manner.

6. A method for advancing cylindrical bodies according to claim 5 wherein the cylindrical bodies that can be fixedly connected by said fixing member are first and second cylindrical bodies.

7. A method for advancing at least two cylindrical bodies underground in succession, wherein a horizontal hole is arranged to have a start pit and an arrival pit communicate with each other therethrough, a traction member is arranged to pierce through the inside of said horizontal hole and to project into said two pits; at the opening of the horizontal hole on the side of said arrival pit, there is disposed a reaction body; said traction member is fixed to said reaction body by means of a removable-and-attachable fastener; another fastener which is arranged to be removable from and attachable to said traction member is disposed in the rear of the rearmost body of said at least two cylindrical bodies laid on the side of said start pit; a thrusting jack arrangement is disposed between one cylindrical body and another; a connecting member is arranged to pierce through more than one cylindrical body disposed in front of the rearmost cylindrical body; a fastener which is arranged to removably and reattachably fix said connecting member to the cylindrical body is disposed at the fore end of said connecting member while, at the rear part of the rearmost cylindrical body, there is provided a removable-and-attachable fastener which is arranged to engage said connecting member therewith; in moving forward the cylindrical bodies other than the rearmost one, the thrusting jack arrangement disposed in the rear of each cylindrical body is operated to move the cylindrical body forward with a required reaction force obtained from a sum total of the reaction forces of subsequent cylindrical bodies and that of the reaction body available through said traction member; in moving the rearmost cylindrical body forward, the first and second advancing jack arrangements are simultaneously operated with a required reaction force obtained from a sum total of the reaction force developed at said reaction body through said traction member and the reaction force of one or a plurality of cylindrical bodies fixedly connected by fasteners disposed before the rearmost cylindrical body; and said at least two cylindrical bodies are thus advanced underground by repeating the processes defined in the foregoing.

8. A method for advancing at least two cylindrical bodies according to claim 13, wherein said fastener which is disposed in the rearmost part of said at least two cylindrical bodies and is arranged to be removably and attachably engage with said traction member is attached to a first advancing jack; said fastener of said connecting member disposed in the rear of the rearmost cylindrical body is attached to a second advancing jack; and said fastener disposed in the front part of said connecting member is attached to the connecting member in front of one or two or more than two cylindrical bodies disposed in front of the rearmost cylindrical body.

9. A method for advancing at least two cylindrical bodies underground in succession, wherein there is provided a horizontal hole which is arranged to have a start pit and an arrival pit communicate with each other therethrough; a reaction body is disposed in said arrival pit at the opening of said horizontal hole; traction member is arranged to pierce through said reaction body, said horizontal hole and through said at least two cylindrical bodies laid in alignment on the side of said start pit; at one end of said traction member, there is provided a removable-and-attachable fastener of the traction member while, at the other end of the traction member, there is provided a first advancing jack arrangement provided with a fastener which is removable from and attachable to said traction member, said traction member thus being locked respectively at said reaction body and in the rear of the rearmost body of said at least two cylindrical bodies laid on the side of said start pit; a thrusting jack arrangement is disposed between one cylindrical body and another; a connecting member is arranged to pierce through and project from each of said cylindrical bodies with fasteners of said connecting member which is arranged to removably and attachably fix said connecting member in place being respectively attached to said connecting member in the rear of a second cylindrical body and other cylindrical bodies subsequent thereto; in front of a foremost cylindrical body, there is provided a second advancing jack arrangement which is provided with said fastener of the connecting member and is engaged thereby with said connecting member; with cylindrical body advancing facilities arranged as defined above, each of the cylindrical bodies other than the rearmost one is moved forward one after another by operating the thrusting jack arrangement disposed in the rear of the cylindrical body to be advanced with a required reaction force obtained from a sum total of the reaction force of other cylindrical bodies available through said thrusting jack arrangement and said connecting member and the reaction force of said reaction body available through said traction member; then, in moving the rearmost cylindrical body forward, said first and second advancing jack arrangements are simultaneously operated to move it forward with a required reaction force obtained from a sum total of the reaction force of said reaction body available through said traction member and the reaction force available through said connecting member from one or a plurality of cylindrical bodies which are disposed before the rearmost one and are fixed by said fasteners of said connecting member; and at least two cylindrical bodies are thus advanced underground by repeating the processes defined above.

10. A method for advancing underground at least three cylindrical bodies in succession, wherein there is provided a horizontal hole which is arranged to have a start pit and an arrival pit communicate with each other therethrough; a traction member is arranged to pierce through the inside of said horizontal hole and to project into said pits; a reaction body is disposed in said arrival pit; in said arrival pit, there is provided a traction-type first advancing jack arrangement which is provided with a removable-and-attachable fastener of said traction member, said fastener being arranged to engage said traction member with said reaction body; in said start pit, at least three cylindrical bodies are aligned with a fastener of said traction member disposed in the rear of each of the cylindrical bodies other than the rearmost one, these fasteners being arranged to have said traction member engaged with said cylindrical bodies; a removable-and-attachable fixing arrangement is disposed in the rear of the rearmost cylindrical body to have this cylindrical body engaged with said traction member; further, a first thrusting jack arrangement and a second thrusting jack arrangement are disposed respectively between the first and second cylindrical bodies and between the second and third cylindrical bodies; then, a connecting member is arranged to pierce through each of the second and subsequent cylindrical bodies; in the rear of each of the third and subsequent cylindrical bodies, there is provided a removable-and-attachable fastener of said connecting member, each of these fasteners being arranged to engage said connecting member with each of said cylindrical bodies; in front of the second cylindrical body, an advancing jack arrangement which is provided with a fastener for engaging the connecting member with the cylindrical body; with a cylindrical body advancing facilities arranged in this manner, the first cylindrical body is moved forward by operating said first thrusting jack arrangement to push it with a required reaction force obtained from the reaction force of said second cylindrical body and, with the fastener in the rear of the first cylindrical body fixed to said traction member, said traction-type first advancing jack arrangement is operated to pull the first cylindrical body simultaneously with the pushing operation of said first thrusting jack arrangement with a required reaction force obtained from said reaction body through said traction member; in moving the second cylindrical body forward, said traction-type first advancing jack arrangement and said second thrusting jack arrangement are simultaneously operated to move the second cylindrical body forward with a required reaction force obtained from a sum total of the reaction force developed at said reaction body through said traction member and the reaction force of the third cylindrical body; in moving the third and subsequent cylindrical bodies with the exception of the rearmost cylindrical body, the fastener of the traction member and the fastener of the connecting member which are disposed in the rear of the cylindrical body to be moved forward respectively fixed to the traction and connecting members and then said traction-type first advancing jack arrangement and said advancing jack arrangement are simultaneously operated to move the cylindrical body by pulling it with a required reaction force obtained from a sum total of the reaction force of said reaction body developed through said traction member and that of the second cylindrical body developed through said connecting member; then, in moving the rearmost cylindrical body forward, said fixing arrangement is fixed to said traction member and the fastener disposed there is fixed to said connecting member and said traction-type first advancing jack arrangement and said advancing jack arrangement are simultaneously operated to pull and move forward the rearmost cylindrical body with a required reaction force obtained from a sum total of the reaction force of said reaction body developed through said traction member and that of the second cylindrical body developed through said connecting member; and at least three cylindrical bodies are thus moved forward underground one by one by repeating the processes defined above.

11. A method for advancing cylindrical bodies according to claim 10, wherein said removable-and-attachable fixing arrangement provided in the rear of the rearmost cylindrical body for engaging said traction member with said rearmost cylindrical body is a fastener which permits engagement and disengagement of said traction member.

12. A method for advancing cylindrical bodies according to claim 10, wherein said removable-and-attachable fixing arrangement which is provided in the rear of the rearmost cylindrical body is a traction-type second advancing jack arrangement which is provided with a fastener for engagement and disengagement of said traction member.

13. A method for advancing cylindrical bodies according to claim 10, wherein said advancing jack arrangement which is disposed in front of said second cylindrical body and is provided with the removable-and-attachable fastener of said connecting member for engaging the connecting member with said second cylindrical body is an advancing jack arrangement adapted solely for traction.

14. A method for advancing cylindrical bodies according to claim 10, wherein said advancing jack arrangement which is disposed in front of said second cylindrical body and is provided with the removable-and-attachable fastener of said connecting member for engaging the connecting member with said second cylindrical body is a traction-and-thrusting combined type advancing jack arrangement.

15. An apparatus for advancing at least two cylindrical bodies comprising a traction member which is arranged to pierce through the inside of a horizontal hole connecting a start pit with an arrival pit; a reaction arrangement disposed at the opening of said horizontal hole in said arrival pit; a removable-and-attachable fastener of said traction member, said fastener being arranged to be fixed to said traction member through said reaction arrangement; a first advancing jack arrangement which engages said traction member in the rear of the rearmost of at least two cylindrical bodies aligned on the side of said start pit; a removable-and-attachable fastener which is attached to said traction member through said first advancing jack arrangement; thrusting jack arrangements disposed between said cylindrical bodies; a connecting member which is arranged to pierce through and protrude from the rearmost cylindrical body and at least one cylindrical body disposed in front of the rearmost cylindrical body; removable-and-attachable fasteners of said connecting member arranged to be attached to said connecting member in front of the second one counting from the rear of the alignment of said cylindrical bodies or in front of other cylindrical bodies disposed further forward; a second advancing jack arrangement which is disposed in the rear of the rearmost cylindrical body and is arranged to engage said connecting member; and a removable-and-attachable fastener of said connecting member arranged to be attached to said connecting member through said second advancing jack arrangement.

16. An apparatus for advancing at least two cylindrical bodies comprising a traction member which is arranged to pierce through the inside of a horizontal hole connecting a start pit with an arrival pit; a reaction arrangement disposed at the opening of said horizontal hole in said arrival pit; a traction-type jack arrangement having a fastener which is arranged to removably and reattachably fix said traction member to said reaction arrangement; fasteners which are disposed in the rear of each of at least two cylindrical bodies aligned on the side of said start pit, said fasteners being arranged on said traction member to removably and reattachably fix said traction member in place there; thrusting jack arrangements disposed between said cylindrical bodies; a connecting member arranged to pierce through and protrude from more than two of said cylindrical bodies disposed in the rear part of the alignment of cylindrical bodies; a fastener arranged in the front part of said connecting member to be removable from and attachable to the cylindrical body; and an advancing jack arrangement which is disposed in the rear of the rearmost cylindrical body and is provided with a fastener for engagement with said connecting member, said fastener being arranged to removably and attachably fix said connecting member in place there.

17. An apparatus for advancing cylindrical bodies comprising:

a traction member arranged to pierce through and protrude from the inside of a horizontal hole which have a start pit and an arrival pit communicating with each other;

a reaction arrangement disposed at the opening of said horizontal hole on the side of said arrival pit;

a traction-type first advancing jack arrangement provided with a removable-and-attachable fastener of said traction member arranged to engage said traction member with said reaction arrangement;

fasteners of said traction member which are disposed in the rear of each of cylindrical bodies other than the rearmost one aligned on the side of said start pit, said fasteners being arranged to engage said traction member with the rear parts of said cylindrical bodies;

a removable-and-attachable fastening arrangement of said traction member, said fastening arrangement being arranged in the rear of the rearmost cylindrical body to engage said traction member with said cylindrical body there;

first and second thrusting arrangements disposed respectively between the first and second cylindrical bodies and between the second and third ones;

a connecting member arranged to pierce through and protrude from the second and subsequent cylindrical bodies;

removable-and-attachable fasteners of said connecting member disposed in the rear of each of the third and subsequent cylindrical bodies, said fasteners being arranged to engage said connecting member with said cylindrical bodies; and an advancing jack arrangement disposed in front of said second cylindrical body, said jack arrangement being provided with said fastener of said connecting member to have said connecting member engaged with said second cylindrical body.

18. An apparatus for advancing cylindrical bodies according to claim 17, wherein said removable-and-attachable fastening arrangement of said traction member which is disposed and arranged in the rear of said rearmost cylindrical body to engage said traction member with said cylindrical body is a removable and attachable fastener of said traction member.

19. An apparatus for advancing cylindrical bodies according to claim 17, wherein said removable-and-attachable fastening arrangement of said traction member which is disposed and arranged in the rear of said rearmost cylindrical body to engage said traction member with said cylindrical body is a traction-type second advancing jack arrangement provided with a removable-and-attachable fastener of said traction member.

20. An apparatus for advancing cylindrical bodies according to claim 17, wherein said advancing jack arrangement which is disposed in front of said second cylindrical body and is provided with said fastener of said connecting member to have said connecting member engaged with said second cylindrical body is an advancing jack arrangement adapted solely for traction.

21. An apparatus for advancing cylindrical bodies according to claim 17, wherein said advancing jack arrangement which is disposed in front of said second cylindrical body and is provided with said fastener of said connecting member to have said connecting member engaged with said second cylindrical body is a traction-and-thrusting combined advancing jack arrangement.

22. A method for advancing cylindrical bodies underground one by one in a continuous manner wherein an anchor body is disposed underground in front of a first cylindrical body which is laid in a predetermined position; an anchor member which has one end thereof anchored in said anchor body is arranged to have the other end thereof project to the rear of said first cylindrical body; and an advancing jack is arranged in the rear of said first cylindrical body to cause the first cylindrical body moved forward underground to an extent equal to the length of one cylindrical body by pulling said anchor member by means of said advancing jack and wherein a second cylindrical body is laid in the rear of said first cylindrical body; said advancing jack is moved to the rear of said second cylindrical body and, at the same time, a first thrusting jack is arranged between said first and second cylindrical bodies; said first cylindrical body is moved forward by operating the first advancing jack with a required reaction force obtained from a sum total of the reaction forces of said anchor body and said second cylindrical body; then, the advancing jack disposed in the rear of the second cylindrical body is operated to pull said anchor member to have the second cylindrical body moved forward; after the first and second cylindrical bodies have been advanced underground to an extent equal to the length of two cylindrical bodies, then, in the third stage of process, a third cylindrical body is laid in the rear of the second cylindrical body; said anchor member and said advancing jack are removed; a traction jack is installed in front of the first cylindrical body while a second thrusting jack is installed between the second and third cylindrical bodies; a fastener is disposed in the rear of the third cylindrical body and is connected to the traction jack by a traction member; the first cylindrical body is moved forward by operating the first thrusting jack with a required reaction force obtained either from the reaction force of the second cylindrical body or from a sum total of the reaction forces of the second and third cylindrical bodies; then the second thrusting jack is operated to move forward the second cylindrical body with a required reaction force obtained either from the reaction force of the third cylindrical body or from a sum total of the reaction forces of the third and first cylindrical bodies; the traction jack disposed in front of the first cylindrical body is operated to move forward the third cylindrical body by pulling it through the traction member fixed to the fastener disposed in the rear of the third cylindrical body with a required reaction force obtained from the reaction force of the first cylindrical body or from a sum total of the reaction forces of the first and second cylindrical bodies; then, each of cylindrical bodies subsequent to the third cylindrical body is moved forward by pulling it in the same manner as in the process applied to the third cylindrical body; and the underground cylindrical bodies are moved forward one after another by repeating the first, second and third processes defined above.

23. A method for advancing cylindrical bodies underground one by one in a continuous manner wherein an anchor body is disposed underground in front of a first cylindrical body which is laid in a predetermined position; an anchor member which has one end thereof anchored in said anchor body is arranged to have the other end thereof project to the rear of said first cylindrical body; and an advancing jack is arranged in the rear of said first cylindrical body to cause the first cylindrical body moved forward underground to an extent equal to the length of one cylindrical body by pulling said anchor member by means of said advancing jack and wherein said second cylindrical body which is disposed in the rear of said first cylindrical body is formed to be shorter than the first one; said advancing jack is moved to the rear of the second cylindrical body and is arranged to take firm hold of said anchor member; a thrusting jack is disposed between the first and second cylindrical bodies; the thrusting jack is operated to move the first cylindrical body forward with a required reaction force obtained from a sum total of the reaction forces of the second cylindrical body and the anchor body; then, in moving the second cylindrical body forward, said advancing jack is operated to pull said anchor member; after the first and second cylindrical bodies are moved forward to a predetermined position by repeating the processes described above, said anchor member and said advancing jack are removed; a traction jack is disposed in front of the first cylindrical body; fasteners are disposed in the rear of the second cylindrical body and in the rear of each of the cylindrical bodies arranged subsequent to the second one; said traction jack is connected with said fasteners through said traction member; in moving the first cylindrical body, said thrusting jack is operated to move forward the first cylindrical body with a required reaction force obtained from a sum total of the reaction forces of the second and third cylindrical bodies; to move the second cylindrical body forward, the fastener disposed in the rear of the second cylindrical body is fixed to said traction member while the fasteners disposed in the rear of other cylindrical bodies are set free and said traction jack is operated to pull said traction member thus to move the second cylindrical body forward with a required reaction force obtained from the first cylindrical body; and the third cylindrical body and other cylindrical bodies subsequent to the third one are moved forward one by one by operating said traction jack in the same manner as in the case of the second cylindrical body.

* * * * *